US009049521B2

(12) United States Patent
Itano et al.

(10) Patent No.: US 9,049,521 B2
(45) Date of Patent: Jun. 2, 2015

(54) LOUDSPEAKER MAGNETIC CIRCUIT AND LOUDSPEAKER USING SAME

(71) Applicant: Panasonic Corporation, Osaka (JP)

(72) Inventors: Tetsushi Itano, Mie (JP); Masaki Suzumura, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/303,608

(22) Filed: Jun. 13, 2014

(65) Prior Publication Data

US 2014/0294228 A1 Oct. 2, 2014

Related U.S. Application Data

(63) Continuation of application No. PCT/JP2012/007790, filed on Dec. 5, 2012.

(30) Foreign Application Priority Data

Jan. 11, 2012 (JP) ..... 2012-002724

(51) Int. Cl.

| | |
|---|---|
| ***H04R 25/00*** | (2006.01) |
| ***H04R 15/00*** | (2006.01) |
| ***H04R 9/02*** | (2006.01) |
| ***H04R 3/00*** | (2006.01) |

(52) U.S. Cl.

CPC ..... *H04R 15/00* (2013.01); *H04R 9/025* (2013.01); *H04R 2209/022* (2013.01); *H04R 3/00* (2013.01)

(58) Field of Classification Search

CPC ..... H04R 9/00; H04R 9/025; H04R 9/027
USPC ..... 381/396, 412, 414, 420–422
See application file for complete search history.

(56) References Cited

U.S. PATENT DOCUMENTS

| | | | | |
|---|---|---|---|---|
| 2003/0031338 | A1 | 2/2003 | Suzuki et al. | |
| 2004/0131223 | A1 * | 7/2004 | Stiles | 381/412 |

FOREIGN PATENT DOCUMENTS

| | | |
|---|---|---|
| JP | 64-022200 | 1/1989 |
| JP | 11-055786 | 2/1999 |
| JP | 11-055788 | 2/1999 |
| JP | 2002-078083 | 3/2002 |
| JP | 2007-306214 | 11/2007 |
| JP | 2011-171781 | 9/2011 |
| WO | 2009144773 | 12/2009 |

OTHER PUBLICATIONS

International Search Report of PCT Application No. PCT/JP2012/007790 dated Mar. 5 , 2013.

* cited by examiner

*Primary Examiner* — Suhan Ni
(74) *Attorney, Agent, or Firm* — Panasonic Patent Center

(57) ABSTRACT

A magnetic circuit includes a magnet, a first plate, and a yoke, and has a magnetic gap. The first plate and the yoke are joined to the magnet. The magnet includes first and second magnet parts. The second magnet part has a lower magnetic property than that of the first magnet part. Such a first magnet part is disposed in a vicinity of the magnetic gap. On the other hand, the second magnet part is disposed farther from the magnetic gap than the first magnet part. The first and second magnet parts are connected in parallel to each other. With this configuration, the second magnet part makes a small contribution to the magnetic flux density in the magnetic gap. Therefore, the magnetic property of the second magnet part may be low, and an inexpensive magnet can be used as the second magnet part.

11 Claims, 15 Drawing Sheets

LOUDSPEAKER MAGNETIC CIRCUIT AND LOUDSPEAKER USING SAME

BACKGROUND

1. Technical Field

The technical field relates to a loudspeaker magnetic circuit used in various audio and video apparatuses, including vehicle-mounted applications, and to a loudspeaker.

2. Background Art

FIG. 18 is a sectional view of a conventional outer magnet type magnetic circuit used in a loudspeaker. The conventional magnetic circuit 3 shown in FIG. 18 is an outer magnet type, and includes magnet 1, first plate 2A, and yoke 2B. Both first plate 2A and yoke 2B are formed of magnetic substance.

Yoke 2B includes a bottom part, and a projection (so-called center pole) disposed on the center of the bottom part. Magnet 1 is provided in the center thereof with through-hole 1A. Magnet 1 is mounted on the bottom part of yoke 2B in such a manner that the center pole of yoke 2B penetrates through through-hole 1A.

On the other hand, first plate 2A is placed on the upper surface of magnet 1. With this configuration, magnetic gap 4 is formed between first plate 2A and the center pole of yoke 2B.

As magnet 1 used in such a conventional loudspeaker, a rare-earth magnet having an extremely high magnetic property is used.

SUMMARY

A loudspeaker magnetic circuit includes a first magnet, a first plate, and a yoke. The first magnet includes a first pole in an end thereof and a second pole formed in another end opposite the first pole. The first plate is joined to the first magnet on the first pole. The yoke is joined to the first magnet on the second pole, and faces a side surface of the first plate with a magnetic gap therebetween. The magnet includes a first magnet part and a second magnet part having a magnetic property lower than that of the first magnet part. The first magnet part is disposed nearer to the magnetic gap, and the second magnet part is disposed farther from the magnetic gap than the first magnet part. The second magnet part is magnetically connected in parallel to the first magnet part.

With the above-mentioned configuration, since the first magnet part is disposed in a vicinity of the magnetic gap, a magnetic force of the first magnet part can be concentrated on the magnetic gap efficiently.

The second magnet part farther from the magnetic gap makes a smaller contribution to a value of a magnetic flux density in the magnetic gap. That is to say, even if the second magnet part having a lower magnetic property is disposed farther from the magnetic gap, an influence on the magnetic flux density in the magnetic gap is low. Therefore, magnetic forces of the first and second magnet parts can be concentrated on the magnetic gap efficiently.

DETAILED DESCRIPTION OF PREFERRED EMBODIMENTS

First Exemplary Embodiment

Hereinafter, loudspeaker magnetic circuits of a first exemplary embodiment are described with reference to drawings.

Figure 1:
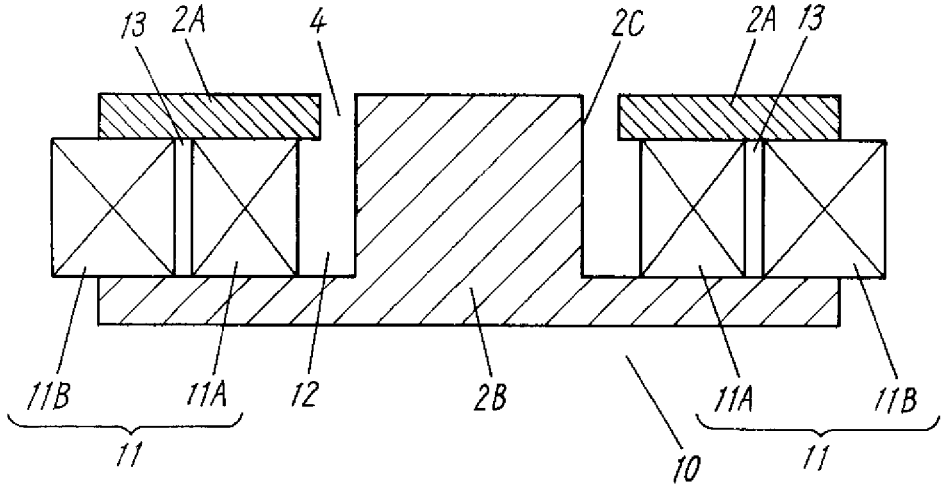
FIG. 1 is a sectional view of a loudspeaker magnetic circuit in accordance with a first exemplary embodiment.

FIG. 1 is a sectional view of a loudspeaker magnetic circuit in accordance with this exemplary embodiment. In FIG. 1, the same reference numerals are given to the same configuration as in a conventional example, and the description thereof is simplified.

Magnetic circuit 10 of this exemplary embodiment includes magnet 11, first plate 2A, and yoke 2B, and has magnetic gap 4 as shown in FIG. 1. A first pole is formed in an end of magnet 11, and a second pole is formed in another end opposite the first pole.

First plate 2A is magnetically connected to the first pole, and yoke 2B is magnetically connected to the second pole. Yoke 2B is magnetically connected to facing part 2C facing a side surface of first plate 2A. Note here that a clearance to be provided with a voice coil (not shown) is disposed between facing part 2C and first plate 2A. With this configuration, magnetic gap 4 is formed between facing part 2C and the side surface of first plate 2A.

Herein, magnet 11 includes first magnet part 11A and second magnet part 11B. Second magnet part 11B has a lower magnetic property than that of first magnet part 11A. First magnet part 11A is disposed in the vicinity of magnetic gap 4. On the other hand, second magnet part 11B is disposed farther from magnetic gap 4 than first magnet part 11A.

The first poles of first magnet part 11A and second magnet part 11B are joined to first plate 2A. On the other hand, the second poles of first magnet part 11A and second magnet part 11B are joined to yoke 2B. That is to say, first magnet part 11A and second magnet part 11B are magnetically connected in parallel to each other.

When first magnet part 11A is disposed nearer to magnetic gap 4, a magnetic flux density in magnetic gap 4 is increased. That is to say, such a disposition enables magnetic energy per unit volume of magnet 11 to be used efficiently.

With the configuration as mentioned above, first magnet part 11A is disposed in the position where contribution to a value of the magnetic flux density in magnetic gap 4 is increased. Therefore, a magnetic force of first magnet part 11A can be efficiently concentrated on magnetic gap 4. Furthermore, since second magnet part 11B is disposed in a position distant from magnetic gap 4, the contribution to the value of the magnetic flux density in magnetic gap 4 is decreased. Therefore, even when the magnetic property of second magnet part 11B is lower than that of first magnet part 11A, an influence on the magnetic flux density in magnetic gap 4 is small. Therefore, magnetic forces of the first magnet part and the second magnet part can be efficiently concentrated on magnetic gap 4.

Hereinafter, Examples of loudspeaker magnetic circuit 10 of this exemplary embodiment are described in detail. As shown in FIG. 1, loudspeaker magnetic circuit 10 of this example is an outer magnet type magnetic circuit, and includes magnet 11, first plate 2A, and yoke 2B. Yoke 2B includes a bottom part and a protrusion (so-called center pole) provided on the center of the bottom part. First plate 2A and yoke 2B are formed of magnetic substance. Note here that magnetic circuit 10 of this example has a circular shape. However, the shape of magnetic circuit 10 of this example is not limited to this shape, and may be other shapes such as a race-track shape and a rectangular shape.

Magnet 11 is provided in the center thereof with through-hole 12. Magnet 11 is mounted on the bottom part of yoke 2B. The center pole of yoke 2B is disposed to penetrate through through-hole 12. First plate 2A is placed on and connected to the upper surface of magnet 11.

Facing part 2C is formed on the side surface of the center pole of yoke 2B. Facing part 2C is disposed so as to face the side surface of first plate 2A. Facing part 2C of this exemplary embodiment is formed on a tip end part of the center pole of yoke 2B. With such a configuration, magnetic gap 4 is formed between the side surface of first plate 2A and facing part 2C. Magnet 11 is disposed such that the first pole is located on an upper surface of magnet 11, and the second pole is on a lower surface of magnet 11. In magnet 11 of this example, the first pole is the N-pole and the second pole is the S-pole. However, magnet 11 of this exemplary embodiment is not necessarily limited to this configuration, and the first pole may be the S-pole and the second pole may be the N-pole.

Magnet 11 includes a plurality of magnet parts. The magnet parts have different magnetic properties from each other. The magnetic property of each of the magnet parts is lower sequentially from the side nearer to magnetic gap 4. All of these magnet parts are magnetically connected in parallel to each other. That is to say, magnetic poles of all the magnet parts face the same direction.

Herein, a case in which magnet 11 includes two magnet parts, i.e., first magnet part 11A and second magnet part 11B is described. In this case, the poles of first magnet part 11A and second magnet part 11B face the same direction. For example, when the upper surface side of first magnet part 11A is the N-pole, the upper surface side of second magnet part 11B is also the N-pole.

In this example, first magnet part 11A employs a magnet having a higher magnetic property than that of second magnet part 11B, and is disposed nearer to magnetic gap 4 than second magnet part 11B. On the other hand, second magnet part 11B employs a magnet having a lower magnetic property than that of first magnet part 11A, and is disposed farther from magnetic gap 4 than first magnet part 11A.

Note here that magnet 11 of this example includes two magnet parts, but may include three or more magnet parts. In this case, these magnet parts are disposed such that the magnetic property of each of the magnet parts becomes smaller sequentially from a position nearer to magnetic gap 4 to a position distant from magnetic gap 4.

Herein, the magnetic properties of first magnet part 11A and second magnet part 11B can be generally compared with each other by using maximum energy product values. Actually, however, evaluation needs to be carried out by the operating point at which magnet 11 is used, and comparison may be carried out by using values of residual magnetic flux density Br or values of holding force HcB.

TABLE 1

| magnet | bond magnet material | residual magnetic flux density Br (T) | holding force HcB (KA/M) |
|---|---|---|---|
| first magnet part 11A | Nd—Fe—B | 0.83 | 477 |
| second magnet part 11B | ferrite | 0.288 | 190 |

Table 1 shows one example of the magnetic properties of first magnet part 11A and second magnet part 11B of this exemplary embodiment. As is apparent from Table 1, all the magnetic properties such as residual magnetic flux density Br, holding force HcB, and the maximum energy product are larger values in first magnet part 11A than in second magnet part 11B.

Note here that a rare-earth magnet such as a neodymium magnet can be used as first magnet part 11A of this example, for example. On the other hand, a ferrite magnet can be used as second magnet part 11B, for example. Since the magnetic property of second magnet part 11B may be lower as described above, a magnet using an inexpensive magnetic substance such as ferrite can be used as second magnet part 11B. Herein, the above-mentioned magnet 11 has a magnetic anisotropy in a vertical direction as a magnetization direction.

TABLE 2

| experimental conditions | position of magnet | magnetic flux density (T) in gap |
|---|---|---|
| Condition 1 | first magnet part 11A is near to magnetic gap | 0.926 |
| Condition 2 | second magnet part 11B is near to magnetic gap | 0.903 |

Table 2 shows the relation between arrangement of first magnet part 11A and second magnet part 11B and the magnetic flux density in magnetic gap 4. Condition 1 shows the measurement result of the magnetic flux density in magnetic gap 4 when first magnet part 11A is disposed nearer to magnetic gap 4 (second magnet part 11B is disposed farther from magnetic gap 4). On the other hand, condition 2 shows the measurement result of the magnetic flux density in magnetic gap 4 when second magnet part 11B is disposed nearer to magnetic gap 4 (first magnet part 11A is disposed farther from magnetic gap 4). At this time, a volume of first magnet part 11A is the same as a volume of second magnet part 11B as shown in FIG. 1. That is to say, amounts of the magnetic energy per unit volume of magnet 11 in condition 1 and condition 2 are the same as each other.

As shown in Table 2, when first magnet part 11A is disposed nearer to magnetic gap 4, the magnetic flux density in magnetic gap 4 is increased. That is to say, the magnetic energy per unit volume of magnet 11 can be used efficiently by disposing first magnet part 11A nearer to magnetic gap 4. When the ratio of a sectional area of first magnet part 11A and a sectional area of second magnet part 11B is appropriately varied, a desired magnetic flux density can be obtained in magnetic gap 4. That is to say, in order to obtain the desired magnetic flux density in magnetic gap 4, the amount of magnetic energy per unit volume of magnet 11 can be reduced.

This configuration enables the magnetic flux of magnet 11 to be concentrated on magnetic gap 4 efficiently. As a result, when first magnet part 11A is disposed nearer to magnetic gap 4, the amount of the magnetic energy per unit volume of magnet 11 may be small. Therefore, a ferrite magnet or the like can be used as second magnet part 11B. Furthermore, as compared with a conventional example, the volume of first magnet part 11A can be also reduced, and hence, the use amount of expensive rare earth-containing rare metal such as neodymium can be reduced.

Figure 18:
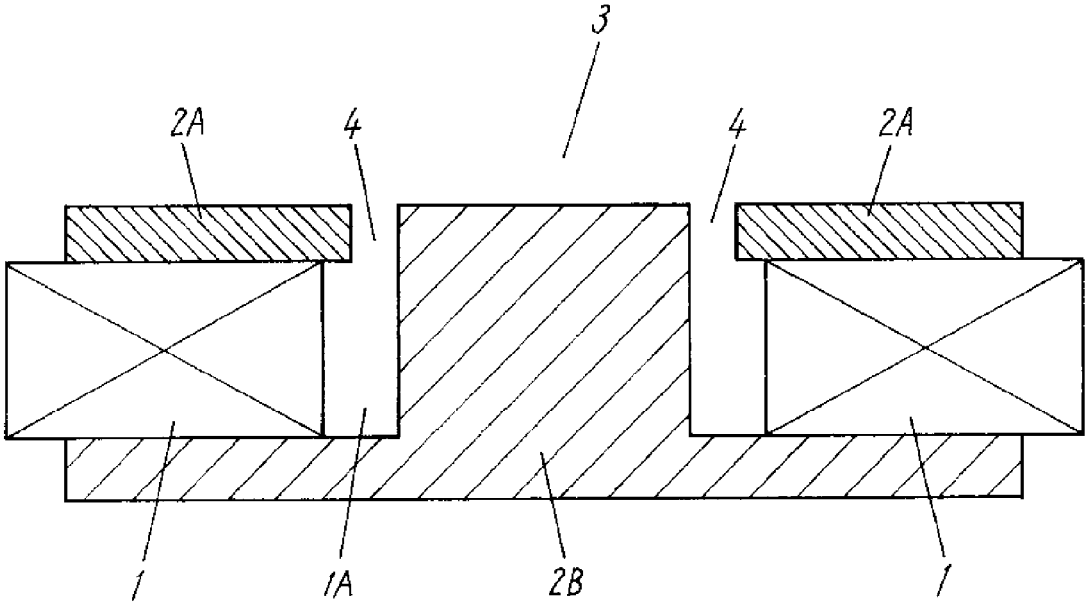
FIG. 18 PRIOR ART
FIG. 18 is a sectional view of a conventional outer magnet type loudspeaker magnetic circuit.

Herein, in conventional magnetic circuit 3 as shown in FIG. 18, in order to obtain a high magnetic flux density in magnetic gap 4, a rare-earth magnet is used as magnet 1. Furthermore, in conventional magnetic circuit 3, in order to reduce the thickness of magnetic circuit 3, a contact area between magnet 1 and yoke 2B needs to be increased. However, as magnet 1 is thinner, the operating point of magnet 1 is lower. Therefore, a magnetic force is reduced irreversibly at high temperatures, and thus the sound pressure of the loudspeaker is deteriorated.

Then, in order to avoid thermal demagnetization, magnet 1 is required to be thick in conventional magnetic circuit 3. However, when magnet 1 is thick, a volume of magnet 1 is large. Therefore, the use amount of rare earth whose price has been recently risen is increased, thus extremely increasing the cost of magnet 1 and increasing the thickness of the loudspeaker itself.

Thus, with the above-mentioned configuration, since the magnetic force of magnet 11 can be concentrated on magnetic gap 4, the magnetic flux density in magnetic gap 4 can increased without increasing the thickness of magnet 11. As a result, the thicknesses of magnet 11 and magnetic circuit 10 can be reduced. Furthermore, since the magnetic property of second magnet part 11B may be lower than that of first magnet part 11A, a less expensive magnet can be used as second magnet part 11B than first magnet part 11A. Therefore, low-priced magnet 11 can be achieved. Furthermore, resource-saving of expensive rare metal such as rare-earth metal can be achieved. As a result, a low-priced loudspeaker magnetic circuit can be obtained.

Furthermore, when the magnetic substance and the volumes of first magnet part 11A and second magnet part 11B are appropriately selected, it is possible to easily achieve magnetic circuit 10 having a high magnetic flux density, magnetic circuit 10 having less variation in the magnetic property due to change of temperature, or the like, which can satisfy various market demands. Therefore, the degree of freedom in design can be improved.

For example, when magnetic gap 4 needs a high magnetic flux density therein, a magnet having large maximum energy product is used as first magnet part 11A. Examples of such magnets include an Sm-Co magnet, an Nd-Fe-B magnet, an Sm-Fe-N magnet, and the like.

Furthermore, when it is desired that variation of the magnetic flux density in magnetic gap 4 due to change of temperature be small, a magnet with less reduction of a magnetic force at high temperatures may be used as second magnet part 11B. Examples of such magnets include an Sm-Co magnet, a ferrite magnet, and the like.

First magnet part 11A and second magnet part 11B are generally formed by sintering. A magnet formed by sintering has a feature of being fragile. Thus, in this example, clearance 13 is provided between first magnet part 11A and second magnet part 11B. With this configuration, first magnet part 11A and second magnet part 11B are not brought into contact with each other at the time of assembly. Therefore, the assembly property of first magnet part 11A and second magnet part 11B can be improved. Furthermore, chipping of corner portions in first magnet part 11A and second magnet part 11B can be suppressed.

In this exemplary embodiment, clearance 13 is a void, but clearance 13 is not necessarily limited to this. For example, clearance 13 may be filled with non-magnetic substance.

Furthermore, second magnet part 11B of this example is made to be not higher than first magnet part 11A. That is to say, bonding between first magnet part 11A and first plate 2A or yoke 2B is stronger than bonding between second magnet part 11B and first plate 2A or yoke 2B. With this configuration, generation of a clearance or the like between first magnet part 11A and first plate 2A or yoke 2B can be suppressed. Even if a clearance is generated between second magnet part 11B and first plate 2A or yoke 2B, its influence on the magnetic flux density in magnetic gap 4 is small. As a result, the magnetic flux density in magnetic gap 4 can be increased. Therefore, for example, the height of first magnet part 11A and a design standard dimension of second magnet part 11B are made to be the same as each other. However, first magnet part 11A has a tolerance in which the height can be increased (plus side) and second magnet part 11B has a tolerance in which the height can be reduced (minus side).

Furthermore, the configuration of magnetic circuit 10 can be applied to not only an outer magnet type but also an inner magnet type or inner/external combination magnet type of magnetic circuit. Furthermore, it can be applied to not only magnetic circuit 10 using a single magnet 11 as shown in this example but also complicated shaped magnetic circuits such as a circuit using a plurality of magnets. In that case, the configuration of magnetic circuit 10 may be used for only a part of the magnetic circuits, or may be used for all the magnetic circuits.

In this example, sintered magnets are used for both first magnet part 11A and second magnet part 11B. However, a bond magnet may be used for at least one of first magnet part 11A and second magnet part 11B. Examples of the bond magnet include a ferrite magnet, an Sm-Co magnet, an Nd-Fe-B magnet, an Sm-Fe-N magnet and the like. Furthermore, a method for forming the bond magnet is not particularly limited, and a forming method may be appropriately selected depending upon the productivity from, for example, extrusion molding, compression molding, injection molding, and the like. From the viewpoint of productivity, ease of installation of magnetically orientating equipment, the injection molding is particularly preferable.

Furthermore, when a bond magnet is used as magnet 11, at least one of yoke 2B and first plate 2A is set in a cavity of a mold in advance, and yoke 2B and/or first plate 2A and magnet 11 can be molded unitarily with each other by injection molding. In this case, in order to join yoke 2B and/or first plate 2A to magnet 11, it is not necessary to use an adhesive. Therefore, magnetic circuit 10 with excellent productivity can be obtained.

Figure 2:
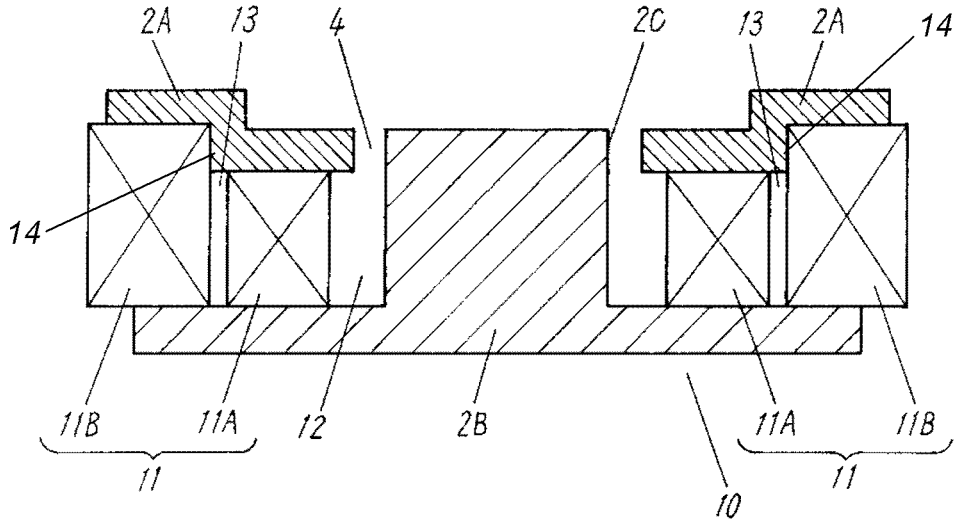
FIG. 2 is a sectional view of an outer magnet type loudspeaker magnetic circuit in accordance with a second example of the first exemplary embodiment.

FIG. 2 is a sectional view of a magnetic circuit in accordance with a second example of this exemplary embodiment. In FIG. 2, the same reference numerals are given to the same elements as in FIG. 1 and the descriptions thereof are simplified. This example is different from the previous example in that the height of second magnet part 11B is different from the height of first magnet part 11A. That is to say, since magnet 11 includes a plurality of magnet parts, when the heights of the magnet parts are appropriately changed, the magnetic flux density in magnetic gap 4 can be made to have a desired value easily.

Figure 13A:
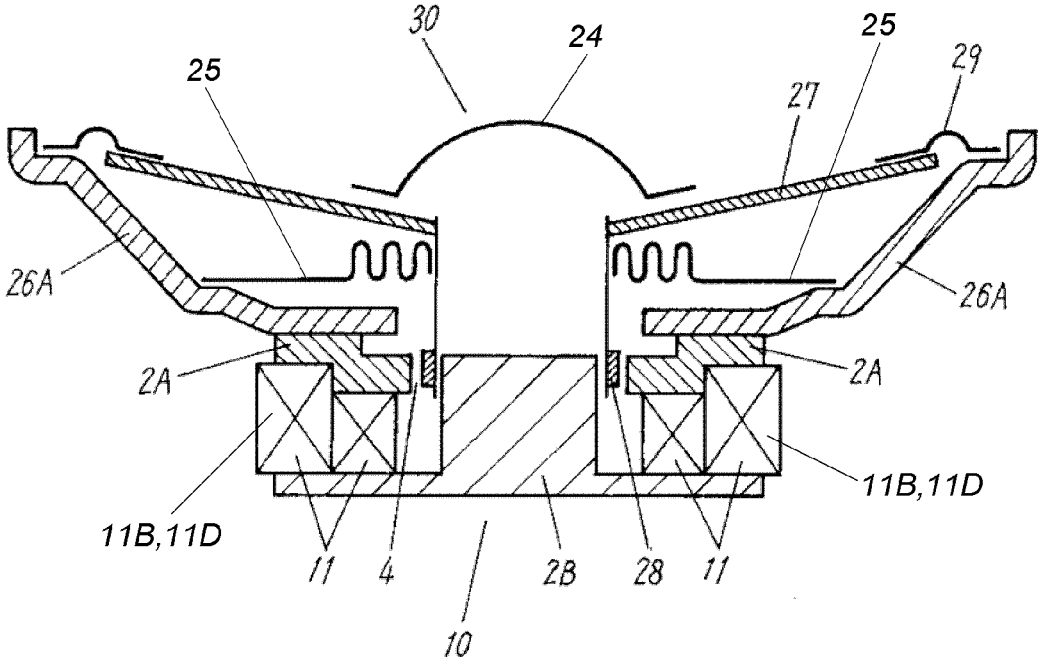
FIG. 13A is a sectional view of an outer magnet type loudspeaker in accordance with a second example of the fourth exemplary embodiment.

Herein, as shown in FIG. 13A, it is necessary that diaphragm 27 (or damper 25) is away from first plate 2A with a distance therebetween in which diaphragm 27 (or damper 25) and first plate 2A are not brought into contact with each other even when voice coil 28 vibrates. On the other hand, since second magnet part 11B is disposed at the outer side from first magnet part 11A, amplitude of diaphragm 27 (or damper 25) is smaller than that in the center part. Therefore, even when second magnet part 11B is high, there is less possibility that diaphragm 27 (or damper 25) and first plate 2A are brought into contact with each other in the position of second magnet part 11B. Thus, in this example, second magnet part 11B is made to be higher than first magnet part 11A. With this configuration, a magnetic flux generated by first magnet part 11A and second magnet part 11B can be transmitted to magnetic gap 4.

Herein, first plate 2A is molded in a crank shape so that it is joined to both first magnet part 11A and second magnet part 11B. Outer peripheral surface 14 of the crank-shaped bent portion of first plate 2A is disposed in the vicinity of (if possible, brought into contact with) the side surface of an inner peripheral surface of second magnet part 11B. With this configuration, a magnetic flux leaking from the side surface of second magnet part 11B can be also collected into magnetic gap 4 in the vicinity portion (or a contact portion) between first plate 2A and the inner peripheral surface of second magnet part 11B.

In this case, however, processing dimensions of first magnet part 11A, second magnet part 11B and first plate 2A are made such that first magnet part 11A and first plate 2A are brought into contact with each other. With this configuration, a magnetic force of first magnet part 11A can be collected into magnetic gap 4. In this case, a clearance may be generated between an upper surface of second magnet part 11B and a lower surface of first plate 2A depending upon variations of processing dimensions of first magnet part 11A, second magnet part 11B and first plate 2A. However, since second magnet part 11B has a smaller influence on the magnetic flux density in magnetic gap 4, variations of the magnetic flux density in magnetic gap 4 caused by the dimension variation of second magnet part 11B can be reduced.

Also in this example, as in the previous example, a bond magnet may be used for at least one of first magnet part 11A and second magnet part 11B.

Figure 3:
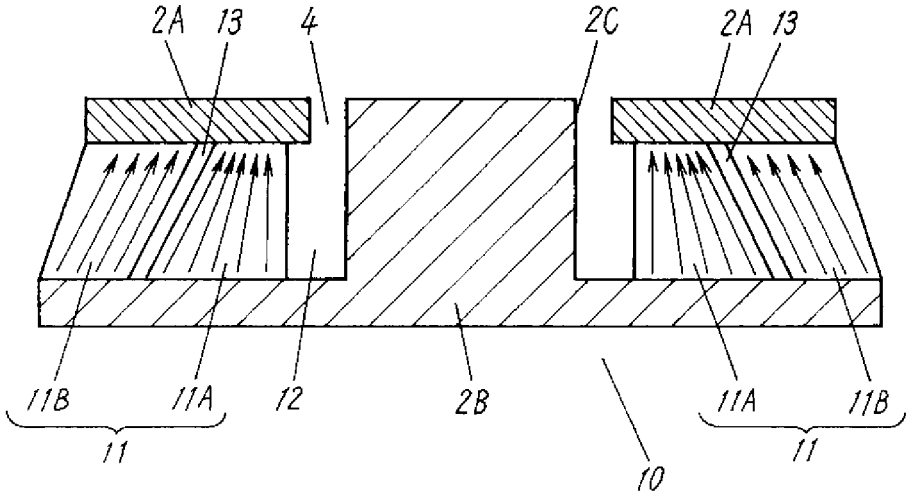
FIG. 3 is a sectional view of an outer magnet type loudspeaker magnetic circuit in accordance with a third example of the first exemplary embodiment.

FIG. 3 is a sectional view of a magnetic circuit in accordance with a third example of this exemplary embodiment. In FIG. 3, the same reference numerals are given to the same elements as in FIGS. 1 and 2, and the descriptions thereof are simplified. The magnetic circuit of this example is different from that of the first example in that first magnet part 11A and second magnet part 11B of this example are bond magnets, and cross-sectional shapes of first magnet part 11A and second magnet part 11B are trapezoidal.

First magnet part 11A of this example has a right-angled trapezoid shape, the upper base provided with the first pole is shorter than the lower base provided with the second pole. First magnet part 11A is disposed in such a manner that the shorter upper base is joined to plate 2A. That is to say, in this example, a contact area between first magnet part 11A and first plate 2A is smaller than a contact area between first magnet part 11A and yoke 2B. Note here that first magnet part 11A and second magnet part 11B of this example are magnetically oriented from the lower base side toward the upper base side (in the direction of an arrow in FIG. 2). That is to say, the magnetic orientations at the inner side of first magnet part 11A and second magnet part 11B are parallel to the side surfaces at the inner side of first magnet part 11A and second magnet part 11B, respectively. On the other hand, the magnetic orientations at the outer side of first magnet part 11A and second magnet part 11B are parallel to the side surfaces at the outer side of the first magnet part 11A and second magnet part 11B, respectively.

With such a configuration, the magnetism of first magnet part 11A having a high magnetic property is concentrated on the upper base of first magnet part 11A. Therefore, the magnetic flux density in magnetic gap 4 can be increased. First magnet part 11A is disposed in such a manner that a right-angle portion is disposed at a magnetic gap 4 side. That is to say, first magnet part 11A is disposed such that the side surface of first magnet part 11A facing second magnet part 11B is inclined toward to the bottom surface of yoke 2B. With this configuration, the magnetic flux of first magnet part 11A and second magnet part 11B are concentrated on first plate 2A at a region nearer to magnetic gap 4. Therefore, the magnetic flux in magnetic gap 4 can be further increased.

Herein, as in the previous example, clearance 13 of this example also prevents first magnet part 11A and second magnet part 11B from being brought into contact with each other. This configuration suppresses the arrival of the magnetic flux of first magnet part 11A to first plate 2A via second magnet part 11B. As a result, the magnetic flux of first magnet part 11A can be efficiently concentrated on magnetic gap 4. Note here that as in the previous example, it is preferable that first magnet part 11A may be joined to first plate 2A and/or yoke 2B more strongly than second magnet part 11B to first plate 2A and/or yoke 2B.

Furthermore, as in the previous example, second magnet part 11B of this example may be higher than first magnet part 11A.

Figure 4A:
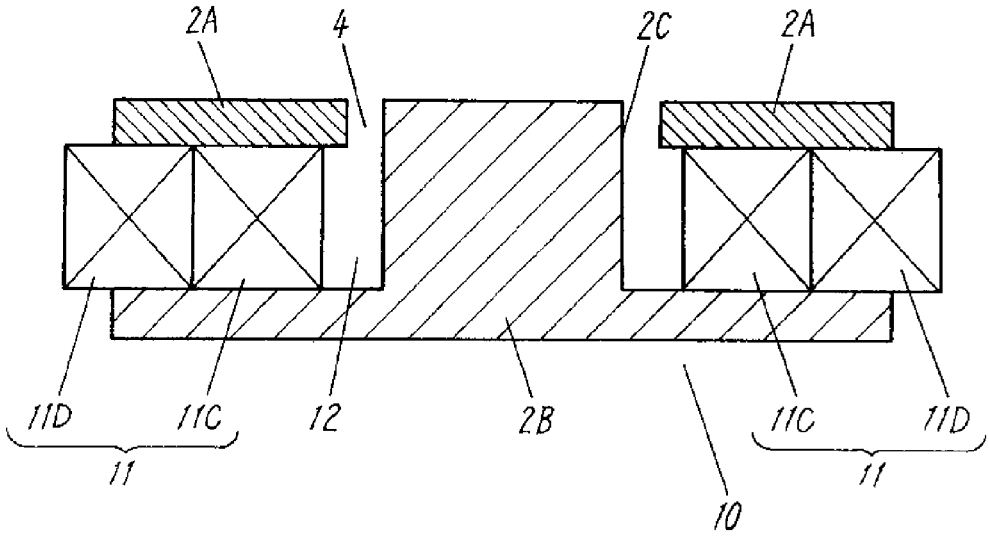
FIG. 4A is a sectional view of an outer magnet type loudspeaker magnetic circuit in accordance with a fourth example of the first exemplary embodiment.

FIG. 4A is a sectional view of a magnetic circuit in accordance with a fourth example of this exemplary embodiment. In FIG. 4A, the same reference numerals are given to the same elements as in FIG. 1 and the descriptions thereof are simplified. This example is different from the first example in that magnet 11 is a bond magnet. Magnet 11 of this example includes a first magnet part formed of a bond magnet (hereinafter, which is referred to as first bond magnet part 11C), and a second magnet part formed of a bond magnet (hereinafter, which is referred to as second bond magnet part 11D). Magnet 11 of this example is formed by unitarily molding first bond magnet part 11C and second bond magnet part 11D with each other.

In first magnet part 11A and second magnet part 11B in the previous examples, first magnet part 11A and second magnet part 11B repel each other at the time of assembly due to a magnetic force generated by themselves. Therefore, assembly is difficult when clearance 13 is not provided. However, since first bond magnet part 11C and second bond magnet part 11D are unitarily molded with each other, thus assembly is unnecessary. Therefore, magnet 11 of this example needs not to be provided with clearance 13. As a result, since an external dimension of magnet 11 can be reduced, the size of the loudspeaker can be reduced.

Next, a method for manufacturing magnet 11 of this example is described. Magnet 11 of this example is formed by unitarily molding first bond magnet part 11C and second bond magnet part 11D by a two-color molding method in a molding die, and thus first bond magnet part 11C and second bond magnet part 11D are unitarily molded with each other. With this method, first bond magnet part 11C and second bond magnet part 11D can be molded simultaneously in the molding die, thus extremely improving the productivity. Therefore, since inexpensive magnet 11 can be manufactured, low-priced magnetic circuit 10 can be achieved.

When molding is carried out in this way, the upper surfaces of first bond magnet part 11C and second bond magnet part 11D can be formed in a plane easily. Furthermore, the lower surfaces of first bond magnet part 11C and second bond magnet part 11D can be also formed in a plane easily. That is to say, there is no step difference in the upper surfaces and/or the lower surfaces of first bond magnet part 11C and second bond magnet part 11D. Therefore, the upper surface of magnet 11 and first plate 2A can be brought into contact with each other reliably, as well as the lower surface of magnet 11 and yoke 2B can be so. Therefore, the magnetic flux density in magnetic gap 4 can be increased.

Furthermore, the other examples of a method for manufacturing magnet 11 of this example include a method for forming magnet 11 by insert molding. In this case, any one of first bond magnet part 11C and second bond magnet part 11D is manufactured by injection molding in advance. Thereafter, the magnet part that has been manufactured in advance is inserted into the molding die, and then the insert molding is carried out. With this procedure, magnet 11 can be molded in which first bond magnet part 11C and second bond magnet part 11D are unitarily formed with each other.

The magnetic property of first bond magnet part 11C and second bond magnet part 11D of this example can be determined by, for example, the content rate of the magnetic substance contained in first bond magnet part 11C and second bond magnet part 11D. That is to say, the content rate of the magnetic substance in first bond magnet part 11C is made to be larger than the content rate of the magnetic substance in second bond magnet part 11D. With this configuration, the magnetic property of first bond magnet part 11C is made to be higher than that of second bond magnet part 11D. Thus, since the use amount of the magnetic substance of second bond magnet part 11D can be reduced, inexpensive magnet 11 can be obtained. Therefore, low-priced magnetic circuit 10 can be achieved.

Needless to say, different kinds of magnetic substance may be used for first bond magnet part 11C and second bond magnet part 11D, and thereby the magnetic property of first bond magnet part 11C may be higher than the magnetic property of second bond magnet part 11D. For example, Nd-Fe-B material can be used for first bond magnet part 11C. On the other hand, ferrite material can be used for second bond magnet part 11D. With this configuration, inexpensive second bond magnet part 11D can be obtained.

Furthermore, magnet 11 of this example has a circular shape, but the shape is not limited to the circular shape. The shape may be the other shapes such as a race-track shape, an elliptical shape, and a rectangular shape.

Figure 4B:
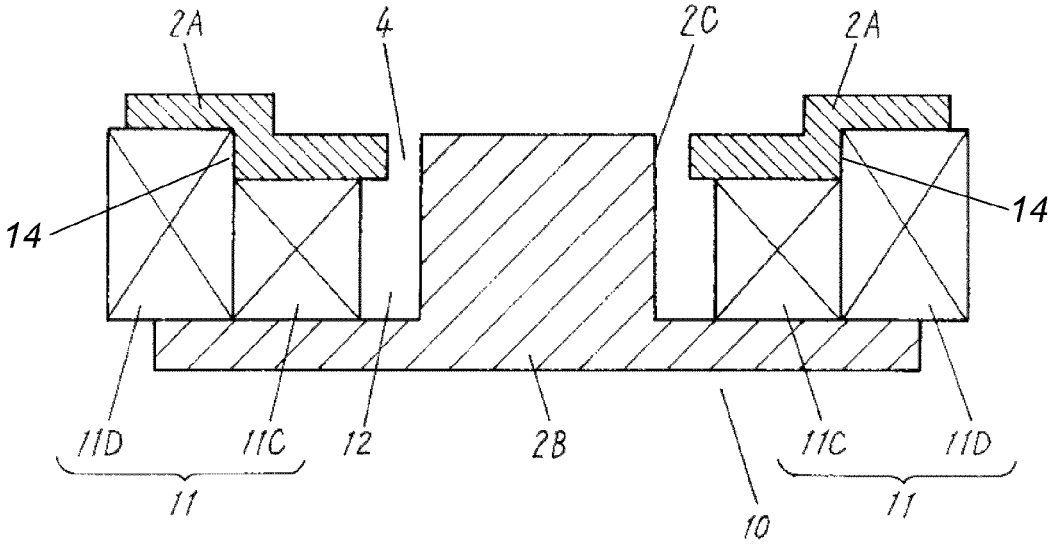
FIG. 4B is a sectional view of an outer magnet type loudspeaker magnetic circuit in accordance with a fifth example of the first exemplary embodiment.

FIG. 4B is a sectional view of a magnetic circuit in accordance with a fifth example of this exemplary embodiment. In FIG. 4B, the same reference numerals are given to the same elements as in FIG. 1 and the descriptions thereof are simplified.

Magnetic circuit 10 of this example is different from magnet circuit 10 of the fourth example in that second bond magnet part 11D is higher than first bond magnet part 11C. That is to say, in this example, first magnet part 11A and second magnet part 11B of the second example are replaced with first bond magnet part 11C and second bond magnet part 11D of the previous example. Therefore, first plate 2A has a crank shape as in the second example. Also in this example, clearance 13 is not needed, first bond magnet part 11C and second bond magnet part 11D are unitarily molded with each other.

Magnetic circuit 10 of this example has effects of both magnetic circuits 10 of the second and fourth examples. In addition, since a volume of second bond magnet part 11D in magnetic circuit 10 of this example can be made to be larger than that of second magnet part 11B in magnetic circuit 10 of the fourth example, the magnetic flux density in magnetic gap 4 can be increased.

Figure 5A:
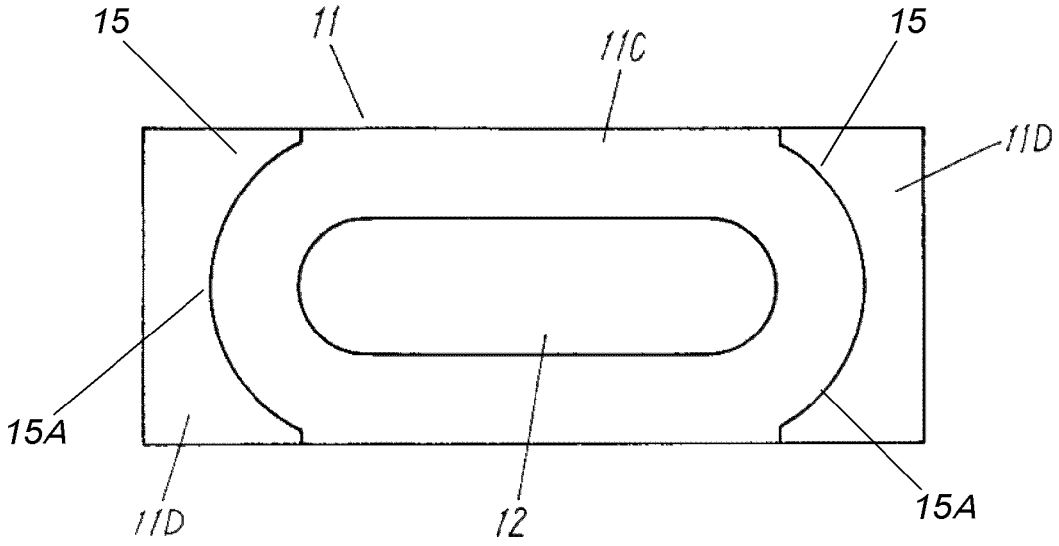
FIG. 5A is a top view of a magnet in accordance with the second example of the first exemplary embodiment.
Figure 5B:
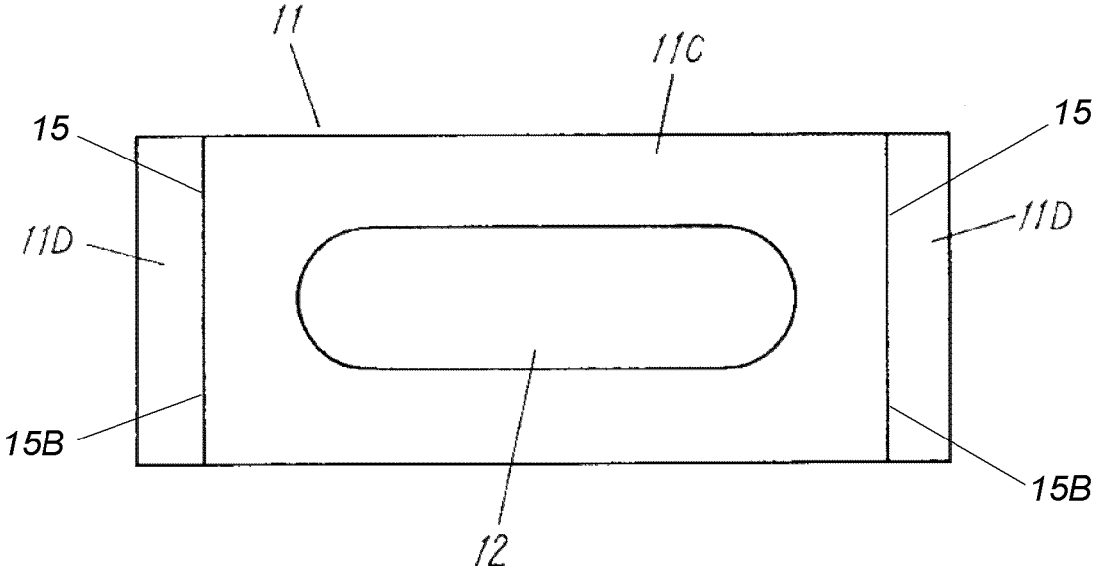
FIG. 5B is a top view of a magnet in accordance with the third example of the first exemplary embodiment.

FIG. 5A is a top view of a magnet in accordance with another example of the magnetic circuit in accordance with the fourth or fifth example. FIG. 5B is a top view of a magnet in accordance with still another example of the magnetic circuit in accordance with the fourth or fifth example. In FIGS. 5A and 5B, the same reference numerals are given to the same elements as in FIG. 4A or 4B and the descriptions thereof are simplified. The outer shape of magnet 11 of these examples are an oblong rectangular shape. In this case, corners of the magnet may be provided with roundness, a C-cut shape, or the like. Furthermore, through-hole 12 of these examples has a race-track shape. In those cases, although not shown, a center pole of yoke 2B of these examples also has a race-track shape. Alternatively, through-hole 12 may have a rectangular shape, and furthermore, the corners of through-hole 12 may be provided with roundness, a C-cut shape, or the like.

A portion around through-hole 12 in the shorter-side direction of magnet 11 of this example is formed of a single magnet part (first bond magnet part 11C). On the other hand, only the longer-side direction of magnet 11 is provided with a plurality of magnet parts (first bond magnet part 11C and second bond magnet part 11D). In this case, in a place near to magnetic gap 4, first bond magnet part 11C is disposed. Therefore, through-hole 12 is provided in first bond magnet part 11C.

On the other hand, second bond magnet part 11D is provided in a place distant from magnetic gap 4. Specifically, second bond magnet part 11D is disposed in both end parts at the longer side of magnet 11. In this case, boundary surface 15 between first bond magnet part 11C and second bond magnet part 11D may be a flat surface or a curved surface.

FIG. 5A is a top view of magnet 11 when boundary surface 15A between first bond magnet part 11C and second bond magnet part 11D is a curved surface. The shape of boundary surface 15A between first bond magnet part 11C and second bond magnet part 11D of this example is closely related to the shape of the circumference of through-hole 12. For example, the shape of boundary surface 15A is similar to the shape of the circumference of through-hole 12. In this case, even when a volume of second bond magnet part 11D is increased, the magnetic flux density in magnetic gap 4 is not likely to be reduced. Therefore, inexpensive magnet 11 can be obtained, thus achieving low-priced magnetic circuit 10.

FIG. 5B shows a magnet in which boundary surface 15B between first bond magnet part 11C and second bond magnet part 11D is a flat surface. When boundary surface 15B is formed in a flat surface, first bond magnet part 11C is molded easily.

Figure 6A:
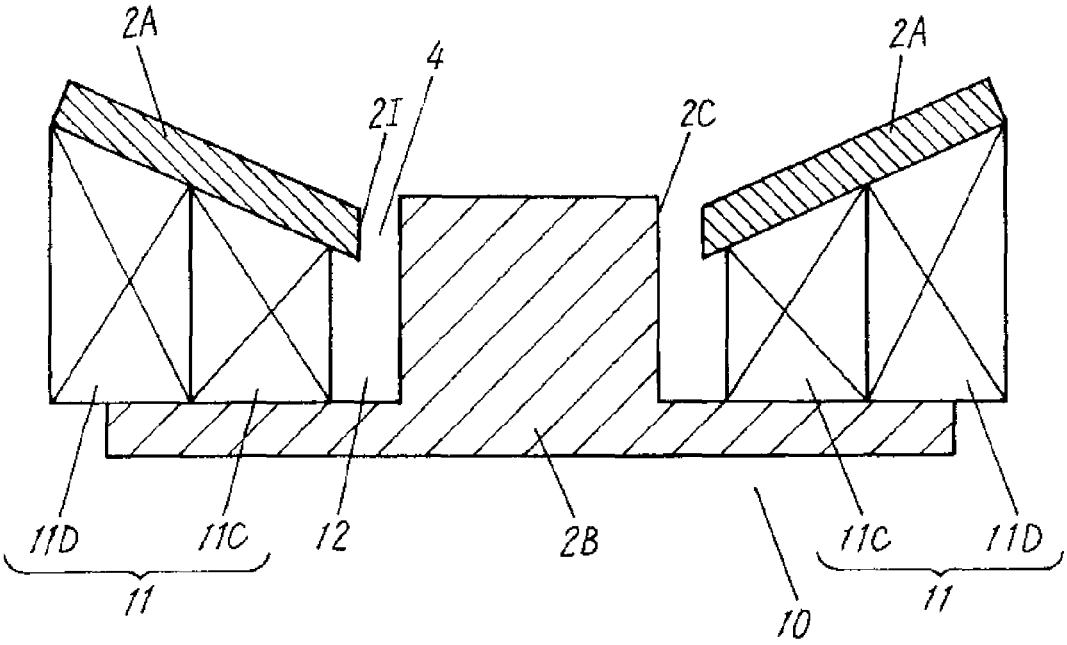
FIG. 6A is a sectional view of an outer magnet type loudspeaker magnetic circuit in accordance with a sixth example of the first exemplary embodiment.
Figure 6B:
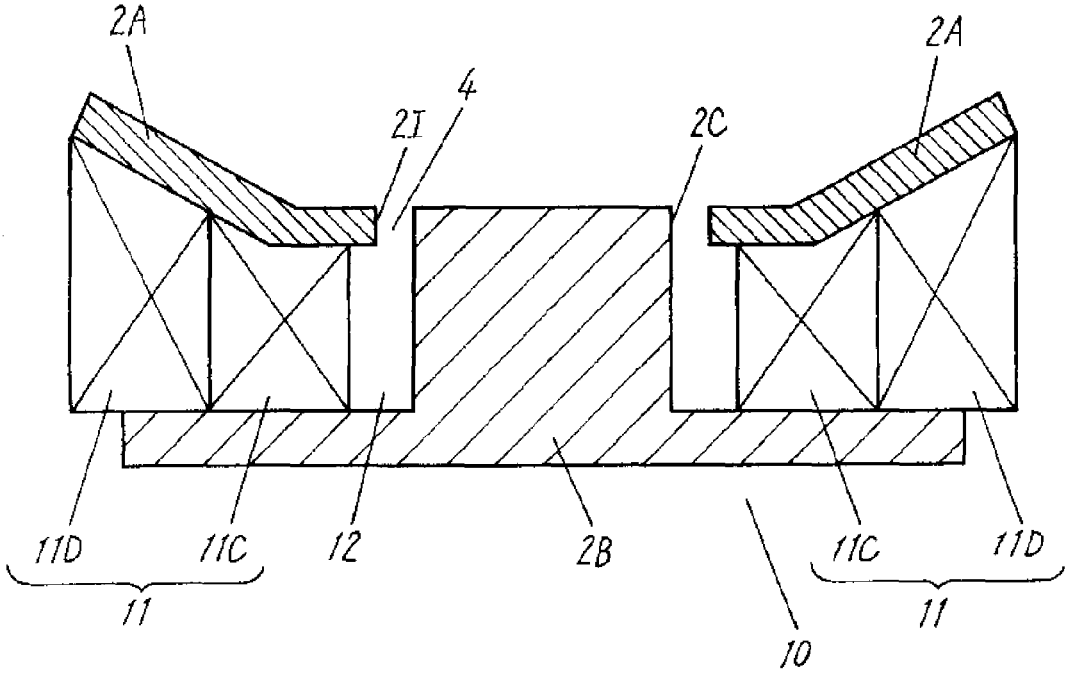
FIG. 6B is a sectional view of an outer magnet type loudspeaker magnetic circuit in accordance with a seventh example of the first exemplary embodiment.

FIG. 6A is a sectional view of a magnetic circuit in accordance with a sixth example of this exemplary embodiment; and FIG. 6B is a sectional view of a magnetic circuit in accordance with a seventh example of this exemplary embodiment. In FIGS. 6A and 6B, the same reference numerals are given to the same elements as in FIGS. 1 and 4, and the descriptions thereof are simplified.

In FIGS. 6A and 6B, magnetic circuits 10 of the examples are different from magnetic circuit 10 in accordance with the fourth example in that second bond magnet part 11D is higher than first bond magnet part 11C. With this configuration, as in magnetic circuits 10 of the second example and the fifth example, the magnetic flux of second bond magnet part 11D can be increased, thus increasing the magnetic flux density in magnetic gap 4.

However, the shape of magnet 11 of the examples is a right-angled trapezoid (or pseudo right-angled trapezoid). In this case, both angles at a yoke 2B side (lower surface side) of magnet 11 are substantially a right angle. That is to say, magnet 11 of this example is disposed in such a manner that an upper surface on which first plate 2A is mounted is inclined. Note here that an outside angle at the yoke 2B side of second bond magnet part 11D may be out of a right angle in an allowable range.

FIG. 6A shows magnetic circuit 10 when flat first plate 2A is used. In this case, first bond magnet part 11C and second bond magnet part 11D are provided such that the upper surfaces thereof are aligned in a plane. Thus, first plate 2A can be formed of a flat plate. Therefore, first plate 2A can be manufactured at a low cost. Furthermore, since the upper surface of magnet 11 is brought into contact with first plate 2A reliably, a magnetic flux density in magnetic gap 4 can be increased.

Note here that a tip end at a center pole side of first plate 2A faces facing part 2C. That is to say, side surface 21 at a center pole side of first plate 2A is formed to have an inclination angle with respect to the upper surface of first plate 2A. The inclination angle of side surface 21 is made to be an angle such that side surface 21 and facing part 2C are parallel to each other in a state in which first plate 2A is placed on magnet 11.

FIG. 6B shows magnetic circuit 10 when a tip end part of a center pole side of first plate 2A is bent. In this case, the tip end part at the center pole side of first plate 2A is bent such that side surface 21 and facing part 2C are parallel to each other in a state in which first plate 2A is placed on magnet 11. Thus, it is not necessary to carry out processing for providing side surface 21 with an inclination angle. Note here that the upper surface of magnet 11 has the same shape as that of the lower surface of first plate 2A.

A position at which first plate 2A is bent is not limited to the above. For example, first plate 2A may have a configuration in which only a tip end part protruding toward through-hole 12 of magnet 11 is bent. In this case, a region in which first plate 2A and magnet 11 are brought into contact with each other is a plane. Therefore, as in the case of the fifth example, first plate 2A and magnet 11 can be brought into contact with each other reliably. As a result, the magnetic flux of magnet 11 can be collected into magnetic gap 4 efficiently, thus increasing the magnetic flux density in magnetic gap 4.

Second Exemplary Embodiment

Figure 7:
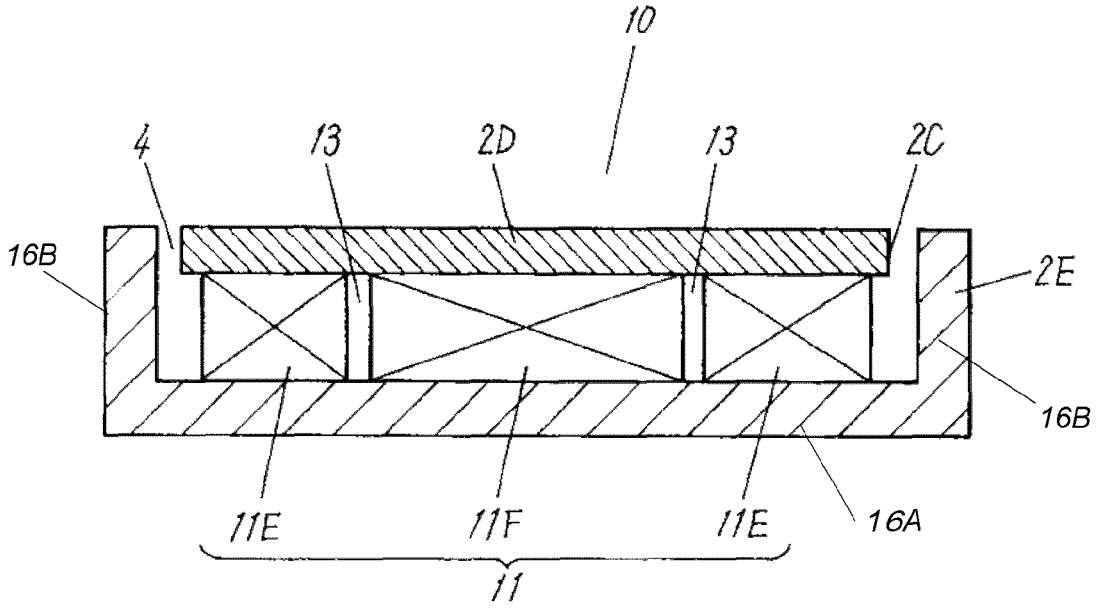
FIG. 7 is a sectional view of an inner magnet type loudspeaker magnetic circuit in accordance with a second exemplary embodiment.

Hereinafter, a second exemplary embodiment is described with reference to drawings. FIG. 7 is a sectional view of a magnetic circuit in accordance with a first example of this exemplary embodiment. As shown in FIG. 7, loudspeaker magnetic circuit 10 of this example is inner magnet type. Magnetic circuit 10 includes magnet 11, first plate 2D, and yoke 2E. Both first plate 2D and yoke 2E are formed of magnetic substance. Yoke 2E is provided with bottom part 16A and side surface portion 16B. Side surface portion 16B is provided so as to stand on a peripheral edge of bottom part 16A. Side surface portion 16B of yoke 2E of this example is formed so as to be bent at about 90° with respect to bottom part 16A. Note here that yoke 2E is formed by bending flat material.

Magnet 11 is mounted on a surface at the inside of the bent portion of yoke 2E, and in the center of yoke 2E. On the other hand, first plate 2D is placed on the upper surface of magnet 11. With this configuration, facing part 2C confronting side surface portion 16B is formed on the side surface of first plate 2D. Specifically, the inner surface of the tip end part of side surface portion 16B confronts facing part 2C. With this configuration, magnetic gap 4 is formed between the inner surface of side surface portion 16B and facing part 2C. In magnet 11 of this example, an upper surface is provided with a first pole and a lower surface thereof is provided with a second pole. The first pole is the N-pole, and the second pole is the S-pole. However, magnetic circuit 10 of this exemplary embodiment is not necessarily limited to this configuration. For example, the first pole may be the S-pole, and the second pole may be made to be the N-pole.

Herein, magnet 11 of this example is provided with a plurality of magnet parts. The magnet parts have different magnetic properties from each other. More specifically, the farther the magnet part is from magnetic gap 4, the lower the magnetic property thereof is. Note here that all these magnet parts are magnetically connected in parallel to each other. That is to say, the magnetic poles of all the magnet parts face the same direction.

Hereinafter, a case in which magnet 11 is formed of two magnet parts, i.e., first magnet part 11E and second magnet part 11F is described. In this case, the poles of first magnet part 11E and second magnet part 11F are disposed to face the same direction. For example, when the upper surface of first magnet part 11E is provided with the N-pole, the upper surface of second magnet part 11F is also provided with the N-pole.

First magnet part 11E has a higher magnetic property than that of second magnet part 11F. First magnet part 11E is disposed nearer to magnetic gap 4 than second magnet part 11F. On the other hand, a magnet having a lower magnetic property than that of first magnet part 11E is used as second magnet part 11F. Second magnet part 11F is disposed farther from magnetic gap 4 than first magnet part 11E. That is to say, first magnet part 11E is disposed at an outer peripheral side, and second magnet part 11F is disposed at an inner side.

Magnetic circuit 10 of this example has a circular shape, but the shape is not limited to this, and may be, for example, a race-track shape and a rectangular shape. Furthermore, magnet 11 of this example includes two magnetic parts but the number of the magnetic parts is not limited to two. Magnet 11 may have, for example, three or more magnetic parts.

For example, a rare-earth magnet such as an Nd-Fe-B magnet is used as first magnet part 11E of this example. On the other hand, a ferrite magnet is used as second magnet part 11F, for example. Since the magnetic property of second magnet part 11F may be low, a magnet formed of an inexpensive magnetic substance such as ferrite can be used as second magnet part 11F. Herein, magnet 11 has magnetic anisotropy in the vertical direction as a magnetization direction.

With the above-mentioned configuration, since first magnet part 11E having a higher magnetic property is disposed nearer to magnetic gap 4, the magnetic flux density in magnetic gap 4 can be increased. Furthermore, the magnetic energy per unit volume of magnet 11 can be efficiently used.

When the ratio of the sectional area (volume) of first magnet part 11E and the sectional area (volume) of second magnet part 11F shown in FIG. 7 is appropriately changed, a desired magnetic flux density can be obtained in magnetic gap 4. As a result, even when the amount of magnetic energy per unit volume of magnet 11 is reduced, a desired magnetic flux density in magnetic gap 4 can be obtained. Therefore, a ferrite magnet or the like also can be used as second magnet part 11F,. Furthermore, as compared with a conventional example, the volume of first magnet part 11E also can be reduced. As a result, the use amount of expensive rare metal including rare earth such as neodymium can be reduced. Therefore, low-priced magnet 11 can be achieved, and resource-saving of rare metal such as rare earth can be achieved. Furthermore, by appropriately selecting the magnetic substance to be used for first magnet part 11E and second magnet part 11F and the volumes thereof, it is possible to achieve magnetic circuit 10 which can respond to various market demands. For example, when a high magnetic flux density is required, magnetic circuit 10 having a high magnetic flux density can be achieved easily. When magnetic circuit 10 having small variation due to change of temperature is required, material having small variation of the magnetic property due to change of temperature can be used so as to easily reduce the variation of the magnetic property due to change of temperature. Therefore, the degree of freedom in designing of magnetic circuit 10 can be improved.

For example, when the magnetic flux density in magnetic gap 4 is desired to be increased, a magnet made of a magnetic substance having a large maximum energy product is used as first magnet part 11E. Examples of first magnet part 11E may include a Sm-Co magnet, an Nd-Fe-B magnet, and an Sm-Fe-N magnet, and the like.

Furthermore, when the variation in the magnetic flux density in magnetic gap 4 due to change of temperature is desired to be reduced, a magnet whose reduction in the magnetic force is small even at high temperatures is used as second magnet part 11F. Examples of second magnet part 11F may include an Sm-Co magnet, a ferrite magnet, and the like.

Furthermore, clearance 13 is provided between first magnet part 11E and second magnet part 11F of this example. With this configuration, first magnet part 11E and second magnet part 11F are not brought into contact with each other at the time of assembly. Therefore, the assembly property of first magnet part 11E and second magnet part 11F into yoke 2E is excellent. Furthermore, it is possible to suppress chipping of corner portions in first magnet part 11E and second magnet part 11F.

The height of second magnet part 11F of this example is made to be not higher than first magnet part 11E. With this configuration, first magnet part 11E can be easily brought into contact with first plate 2D and/or yoke 2E. Therefore, the magnetic flux density in magnetic gap 4 can be increased. Note here that design standard dimensions of the height of first magnet part 11E and the height of second magnet part 11F are made to be the same as each other in this example. However, first magnet part 11E has a tolerance in which the height can be increased (plus side) and second magnet part 11F has a tolerance in which the height can be reduced (minus side).

In this example, magnetic circuit 10 using a single magnet 11 is described. However, this example is not limited to this, and it can be applied to such complicated shaped magnetic circuits as a circuit using a plurality of magnets. In this case, a configuration of magnetic circuit 10 of this example may be used for only a part of the magnetic circuits, or all the magnetic circuits.

Figure 8A:
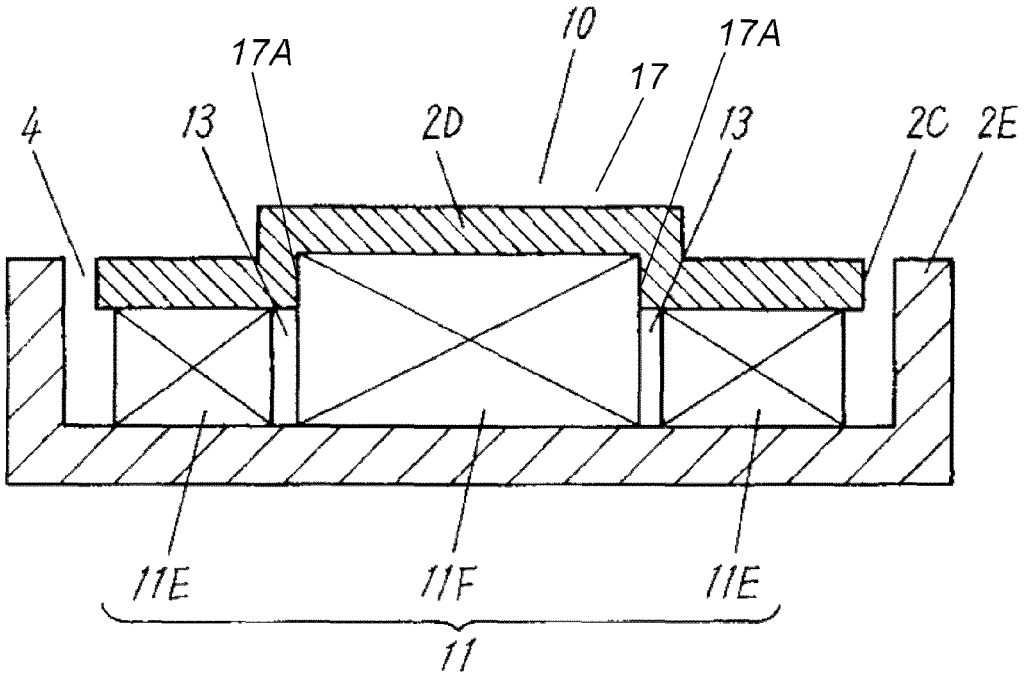
FIG. 8A is a sectional view of an inner magnet type loudspeaker magnetic circuit in accordance with a second example of the second exemplary embodiment.

FIG. 8A is a sectional view of magnetic circuit 10 in accordance with the second example of this exemplary embodiment. In FIG. 8, the same reference numerals are given to the same elements as in FIG. 7 and the descriptions thereof are simplified. This example is different from the previous example in that second magnet part 11F is higher than first magnet part 11E. Furthermore, a cross section of first plate 2D of this example shows that a center part protrudes upward corresponding to second magnet part 11F. That is to say, projection 17 is formed in the center part of first plate 2D.

First magnet part 11E and second magnet part 11F are mounted on yoke 2E. The upper surface of first magnet part 11E is brought into contact with the lower surface of first plate 2D. On the other hand, the upper surface of second magnet part 11F is disposed in the vicinity of (if possible, brought into contact with) the lower surface of first plate 2D.

Figure 15:
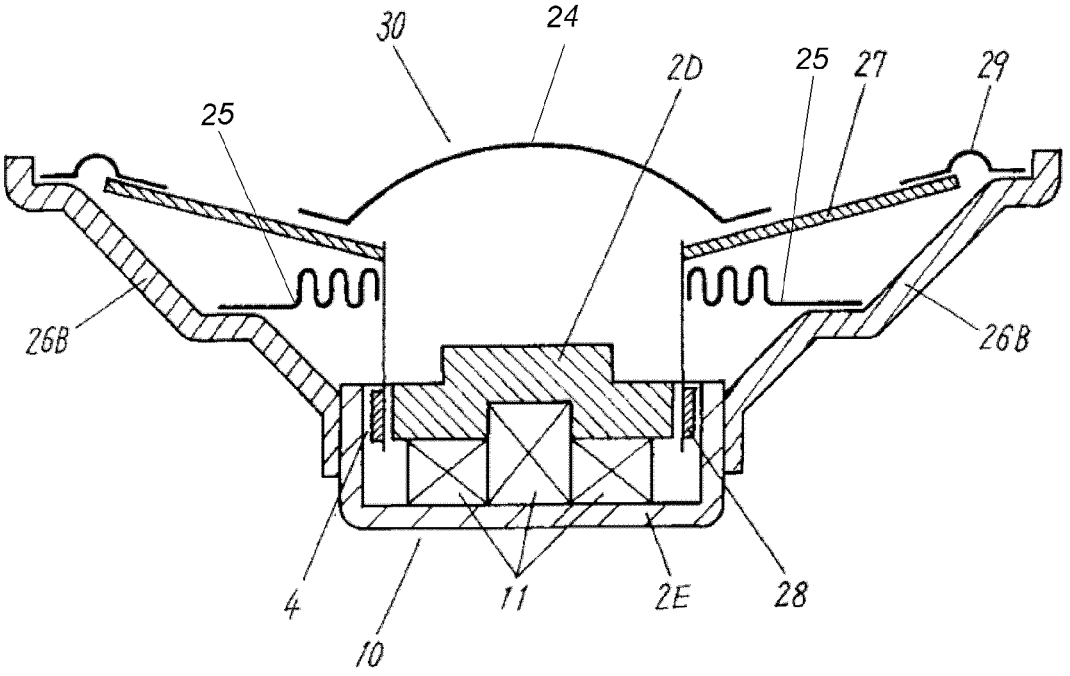
FIG. 15 is a sectional view of an inner magnet type loudspeaker in accordance with a second example of the fifth exemplary embodiment.

As shown in FIG. 15, in a loudspeaker in which dust cap 24 is placed in the center part of diaphragm 27 and which employs inner magnet type magnetic circuit 10, there is a space above magnet 11. Therefore, second magnet part 11F can be higher than first magnet part 11E. Even in such a configuration, second magnet part 11F is not brought into contact with dust cap 24. Furthermore, a volume of second magnet part 11F can be increased. Therefore, the magnetic flux density in magnetic gap 4 can be increased.

Side surface portion 17A at the inner side of first plate 2D is disposed so as to be in the vicinity of (if possible, brought into contact with) a side surface portion of second magnet part 11F. With this configuration, a magnetic flux leaking from the side surface of second magnet part 11F can be collected into magnetic gap 4 by the vicinity portion (or a contact portion).

Figure 8B:
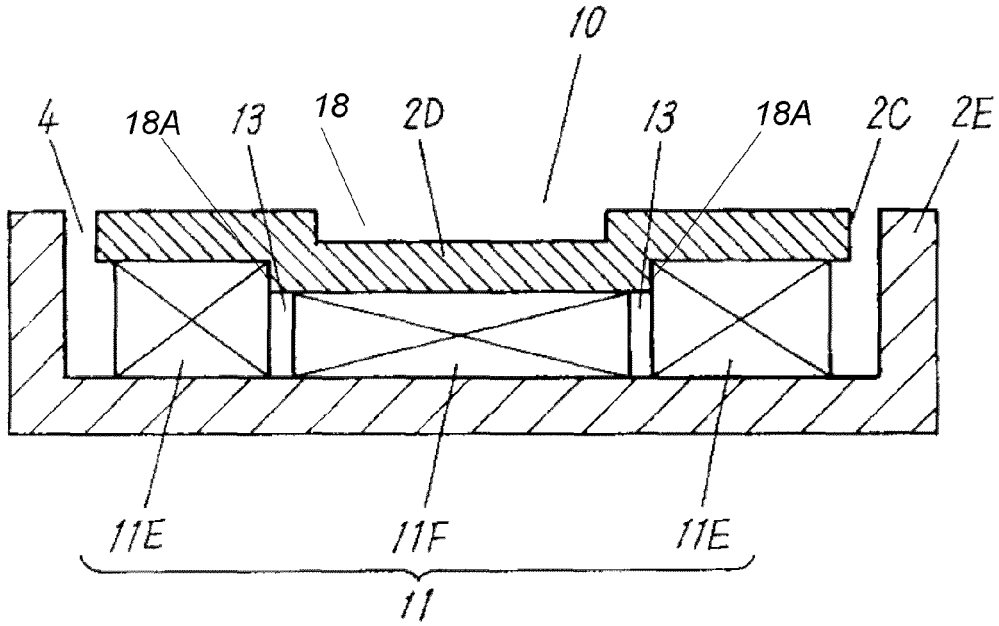
FIG. 8B is a sectional view of an inner magnet type loudspeaker magnetic circuit in accordance with a third example of the second exemplary embodiment.

FIG. 8B is a sectional view of magnetic circuit 10 in accordance with a third example of this exemplary embodiment. In FIG. 8B, the same reference numerals are given to the same elements as in FIG. 7 and the descriptions thereof are simplified. This example is different from the previous example in that second magnet part 11F is lower than first magnet part 11E. Furthermore, a cross section of first plate 2D of this example shows that the center part protrudes downward corresponding to second magnet part 11F. In other words, first plate 2D is provided in the center part thereof with projection 18 protruding toward second magnet part 11F. First plate 2D is mounted so as to protrude toward second magnet part 11F.

With such a configuration, when magnetic circuit 10 of this example and a diaphragm whose center part is a recess are used together, a thin loudspeaker can be achieved. Note here that side surface portion 18A of projection 18 is disposed in the vicinity of (if possible, brought into contact with) an inner side surface portion of first magnet part 11E. With this configuration, a magnetic flux leaking from the side surface of first magnet part 11E can be collected into magnetic gap 4 by this vicinity portion (or a contact portion).

Furthermore, first magnet part 11E, second magnet part 11F and first plate 2D of the second example and the third example have dimension accuracy such that first magnet part 11E and first plate 2D are brought into contact with each other. In these cases, a clearance is formed between the upper surface of second magnet part 11F and the lower surface of first plate 2D. However, second magnet part 11F has a smaller influence on the magnetic flux density in magnetic gap 4 than that of first magnet part 11E. Furthermore, since first magnet part 11E and first plate 2D are brought into contact with each other, first magnet part 11E can be magnetically connected to first plate 2D extremely strongly. With such a configuration, the magnetic flux density in magnetic gap 4 can be increased.

Note here that a bond magnet may be used as at least one of first magnet part 11E and second magnet part 11F of the second and third examples.

Figure 9:
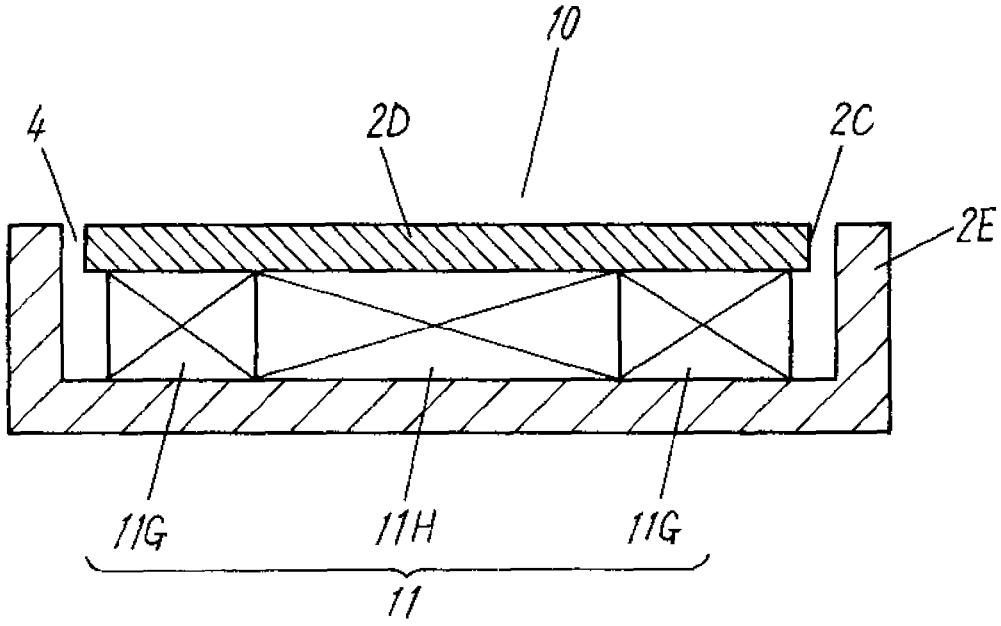
FIG. 9 is a sectional view of an inner magnet type loudspeaker magnetic circuit in accordance with a fourth example of the second exemplary embodiment.

FIG. 9 is a sectional view of a magnetic circuit in accordance with a fourth example of this exemplary embodiment. In FIG. 9, the same reference numerals are given to the same elements as in FIG. 7 and the descriptions thereof are simplified. This example is different from the first example in that magnet 11 is a bond magnet.

Magnet 11 of this example is formed by unitarily forming a first magnet part formed of a bond magnet (hereinafter, which is referred to as first bond magnet part 11G), and a second magnet part formed of a bond magnet (hereinafter, which is referred to as second bond magnet part 11H). That is to say, magnetic circuit 10 of this example does not also need clearance 13.

With such a configuration, an external dimension of magnet 11 can be reduced. Therefore, when magnet 11 of this example is mounted on a loudspeaker, a small-size loudspeaker can be achieved. Note here that magnet 11 of this example can be manufactured by the same method as that for manufacturing first bond magnet part 11C and second bond magnet part 11D in the first exemplary embodiment. Therefore, a low-priced loudspeaker with excellent productivity of magnet 11 can be achieved.

Also in this case, the upper surface of first bond magnet part 11G and the upper surface of second bond magnet part 11H can be aligned in a plane easily. Furthermore, the lower surface of first bond magnet part 11G and the lower surface of second bond magnet part 11H can be also aligned in a plane easily. That is to say, there is no step difference generated between the upper surfaces or between the lower surfaces of first bond magnet part 11G and second bond magnet part 11H. Therefore, the upper surface of magnet 11 and first plate 2D as well as the lower surface of magnet 11 and yoke 2E can be brought into contact with each other reliably. Therefore, the magnetic flux density in magnetic gap 4 can be increased.

Note here that difference of the magnetic property between first bond magnet part 11G and second bond magnet part 11H of this example can be achieved by varying the content rate of the magnetic substance contained in first bond magnet part 11G and second bond magnet part 11H. That is to say, the content rate of magnetic substance in first bond magnet part 11G is higher than that of magnetic substance in second bond magnet part 11H. With this configuration, the magnetic property of first bond magnet part 11G becomes higher than that of second bond magnet part 11H. As a result, the use amount of the magnetic substance of second bond magnet part 11H can be reduced. Therefore, since inexpensive magnet 11 can be obtained, a low-priced magnetic circuit 10 can be achieved.

Needless to say, different magnetic substance may be used for first bond magnet part 11G and second bond magnet part 11H. In this case, magnetic material having a more excellent magnetic property is used for first bond magnet part 11G than that of second bond magnet part 11H. For example, an Nd-Fe-B magnetic material can be used for first bond magnet part 11G. On the other hand, ferrite magnetic material can be used for second bond magnet part 11H. With this configuration, inexpensive magnet 11 can be obtained.

Magnet 11 of this example has a circular shape, but the shape is not limited to the circular shape. The shape may be the other shapes such as a race-track shape, an elliptical shape, and a rectangular shape.

Figure 10A:
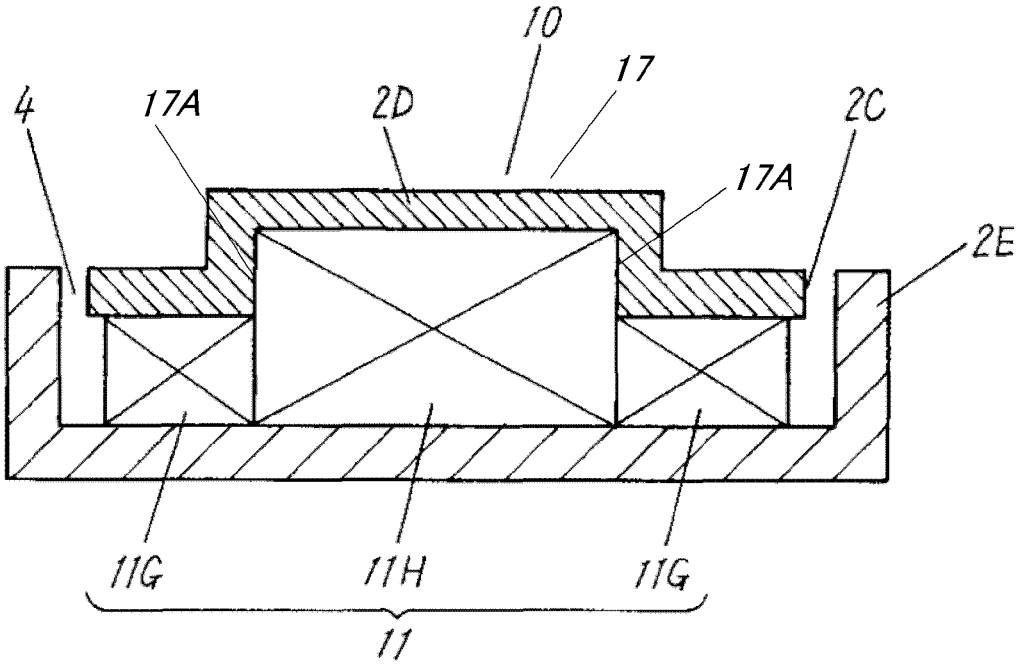
FIG. 10A is a sectional view of an inner magnet type loudspeaker magnetic circuit in accordance with a fifth example of the second exemplary embodiment.

FIG. 10A is a sectional view of a magnetic circuit in accordance with a fifth example of this exemplary embodiment. In FIG. 10A, the same reference numerals are given to the same elements as in FIG. 9 and the descriptions thereof are simplified. In this example, as in magnetic circuit 10 of the previous example, magnet 11 is formed of a bond magnet. That is to say, magnet 11 of this example also has first bond magnet part 11G and second bond magnet part 11H.

However, this example is different from the previous example in that second bond magnet part 11H is higher than first bond magnet part 11G.

In this case, first bond magnet part 11G and second bond magnet part 11H are mounted on yoke 2E. The upper surface of first bond magnet part 11G is brought into contact with first plate 2D. On the other hand, the upper surface of second bond magnet part 11H is disposed in the vicinity of (if possible, brought into contact with) the lower surface of first plate 2D.

As shown in FIG. 15, in a loudspeaker in which dust cap 24 is placed in the center part of diaphragm 27 and which employs inner magnet type magnetic circuit 10, there is a space above magnet 11. Therefore, second bond magnet part 11H can be higher than first bond magnet part 11G. Even in such a configuration, second bond magnet part 11H is not brought into contact with dust cap 24. Furthermore, a volume of second bond magnet part 11H can be increased. Therefore, the magnetic flux density in magnetic gap 4 can be increased.

Herein, side surface portion 17A of projection 17 of first plate 2D is disposed so as to be in the vicinity of (if possible, brought into contact with) a side surface portion of second bond magnet part 11H. With this configuration, a magnetic flux leaking from the side surface of second bond magnet part 11H can be collected into magnetic gap 4 by the vicinity portion (or a contact portion).

Figure 10B:
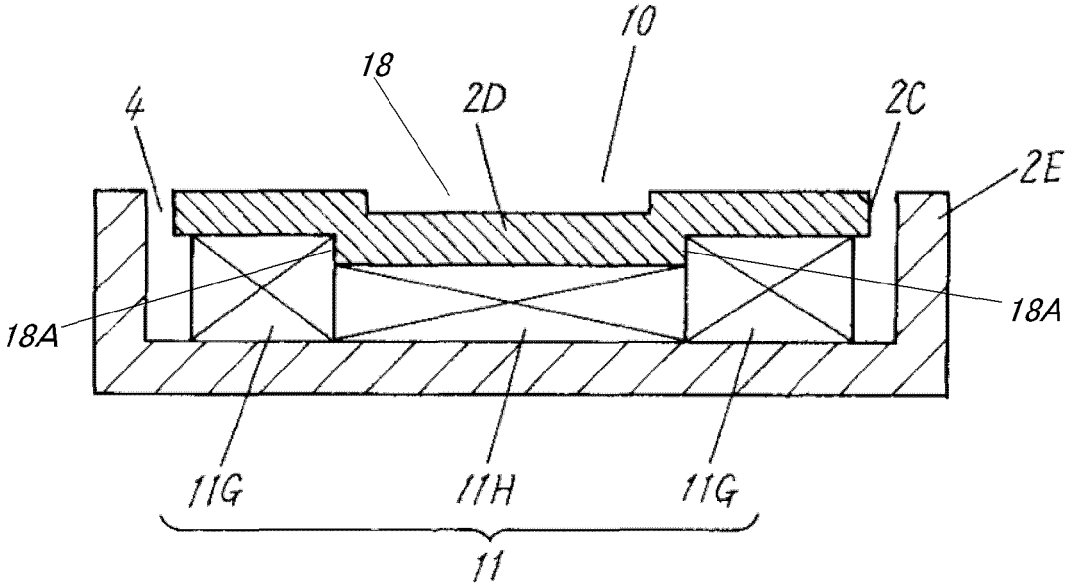
FIG. 10B is a sectional view of an inner magnet type loudspeaker magnetic circuit in accordance with a sixth example of the second exemplary embodiment.

FIG. 10B is a sectional view of magnetic circuit 10 in accordance with a sixth example of this exemplary embodiment. In FIG. 10B, the same reference numerals are given to the same elements as in FIG. 7 and the descriptions thereof are simplified. This example is different from the previous example in that second bond magnet part 11H is lower than first bond magnet part 11G. Furthermore, a cross section of first plate 2D of this example shows that the center part protrudes downward corresponding to second bond magnet part 11H. In other words, first plate 2D is provided in the center part thereof with projection 18 protruding toward second bond magnet part 11H.

Magnetic circuit 10 having this configuration can achieve a particularly thin loudspeaker when a loudspeaker using a diaphragm having a recess shape in the center thereof is used together.

Side surface portion 18A of projection 18 may be disposed in the vicinity of (if possible, brought into contact with) an inner side surface portion of first bond magnet part 11G. With this configuration, a magnetic flux leaking from the side surface of first bond magnet part 11G can be collected into magnetic gap 4 by the vicinity portion (or the contact portion),.

Furthermore, first bond magnet part 11G, second bond magnet part 11H and first plate 2D of the above-mentioned fifth and sixth examples have dimensions or dimension accuracy such that first magnet part 11G and first plate 2D are brought into contact with each other. In these cases, a clearance may be generated between the upper surface of second bond magnet part 11H and the lower surface of first plate 2D. However, first bond magnet part 11G has a larger influence on the magnetic flux density in magnetic gap 4 than second bond magnet part 11H. Furthermore, since first bond magnet part 11G is brought into contact with first plate 2D, first bond magnet part 11G is magnetically connected to first plate 2D extremely strongly.

Therefore, the magnetic flux density in magnetic gap 4 can secured.

Third Exemplary Embodiment

Figure 11A:
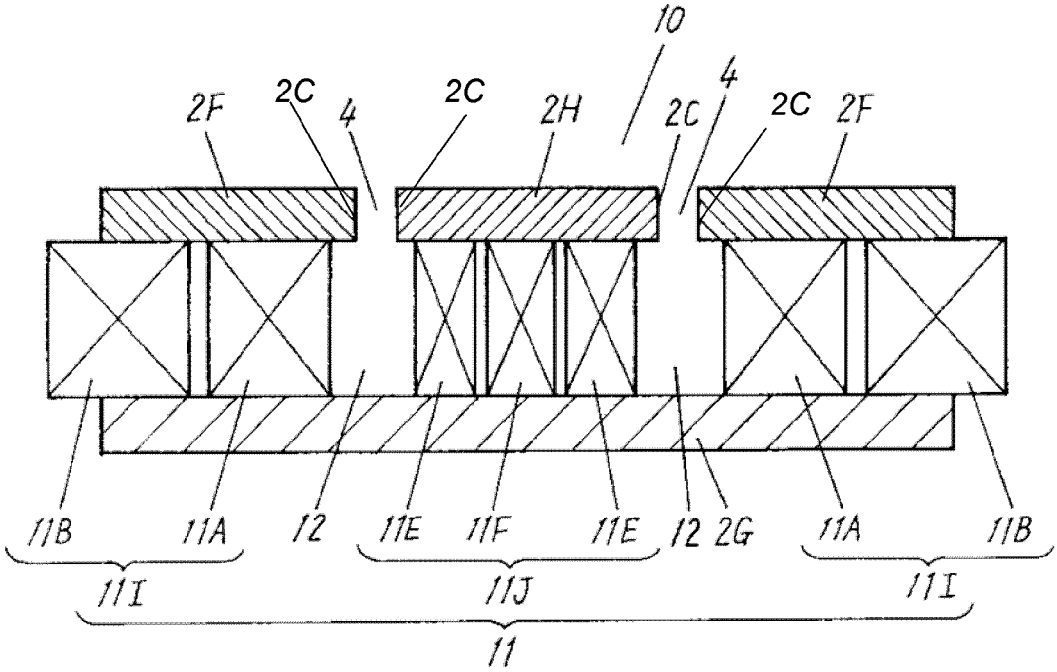
FIG. 11A is a sectional view of an inner and outer magnet type loudspeaker magnetic circuit in accordance with a third exemplary embodiment.

Hereinafter, this exemplary embodiment is described with reference to drawings. FIG. 11A is a sectional view of an inner and outer magnet type loudspeaker magnetic circuit in accordance with the third exemplary embodiment. Magnetic circuit 10 of this exemplary embodiment is obtained by combining magnetic circuit 10 of the first exemplary embodiment and magnetic circuit 10 of the second exemplary embodiment (hereinafter, which is referred to as an "inner and outer magnet type magnetic circuit"). Magnet 11 of this exemplary embodiment includes first magnet 11I including first magnet part 11A and second magnet part 11B and second magnet 11J including first magnet part 11E and second magnet part 11F.

First magnet 11I is mounted on yoke 2G such that second magnet part 11B is disposed at the outer side. First plate 2F is mounted on first magnet 11I. On the other hand, second magnet 11J is mounted on yoke 2G such that second magnet part 11F is disposed at the inner side. Herein, second magnet 11J is disposed in substantially the middle part of through-hole 12 provided in the center of first magnet part 11A. Second plate 2H is mounted on the upper surface of second magnet 11J. Note here that all of yoke 2G, first plate 2F, and second plate 2H are formed of magnetic substance.

A first pole is formed at one side of first magnet 11I, and a second pole is formed at an opposite side to the first pole. Furthermore, a third pole having the same polarity as that of the first pole is formed at one side of second magnet 11J, and a fourth pole is formed at an opposite side to the third pole.

The first pole is joined to first plate 2F and the fourth pole is joined to second plate 2H. On the other hand, the second and third poles are joined to yoke 2G. With this configuration, first magnet 11I and second magnet 11J are connected in series via yoke 2G in magnetic circuit 10 of this example. Facing parts 2C of this example are formed in such a manner that the side surface of second plate 2H and the side surface of first plate 2F face each other. That is to say, there is magnetic gap 4 between facing part 2C of first plate 2F and facing part 2C of second plate 2H. In this example, each of the first and third poles is the N-pole as well as each of the second and fourth poles is the S-pole.

Note here that any magnets 11 may be used as first magnet 11I, as long as magnets 11 are described in first to third examples of first exemplary embodiment. Furthermore, any magnets 11 may be used as second magnet 11J, as long as magnets 11 are described in first to third examples of the second exemplary embodiment.

With the above-mentioned configuration, since first magnet 11I and second magnet 11J are connected in series in magnetic circuit 10 of this example, a magnetic flux density in magnetic gap 4 can be increased. Furthermore, second magnet part 11B has a lower magnetic property than that of first magnet part 11A. Moreover, second magnet part 11F has a lower magnetic property than that of first magnet part 11E. Therefore, second magnet part 11B and second magnet part 11F can be formed of low-priced magnetic material.

For example, second magnet parts 11B and 11F can be formed of a ferrite magnet or a bond magnet. On the other hand, magnetic material having a more excellent magnetic property than that of the ferrite magnet is used for first magnet parts 11A and 11E. For example, a sintered Nd-Fe-B magnet and a sintered Sm-Co magnet can be used as first magnet parts 11A and 11E.

Note here that any one or both of first magnet 11I and second magnet 11J may be formed of a bond magnet.

Furthermore, first magnet 11I of this example has a hollow circular cylindrical shape, and second magnet 11J has a columnar shape. However, the shapes are not necessarily limited to these. For example, first magnet 11I may have substantially a rectangular shape.

Furthermore, second magnet 11J may have a rectangular shape or a race-track shape. Furthermore, first magnets 11I disposed on both sides of second magnet 11J are not necessarily integrated with each other.

Figure 11B:
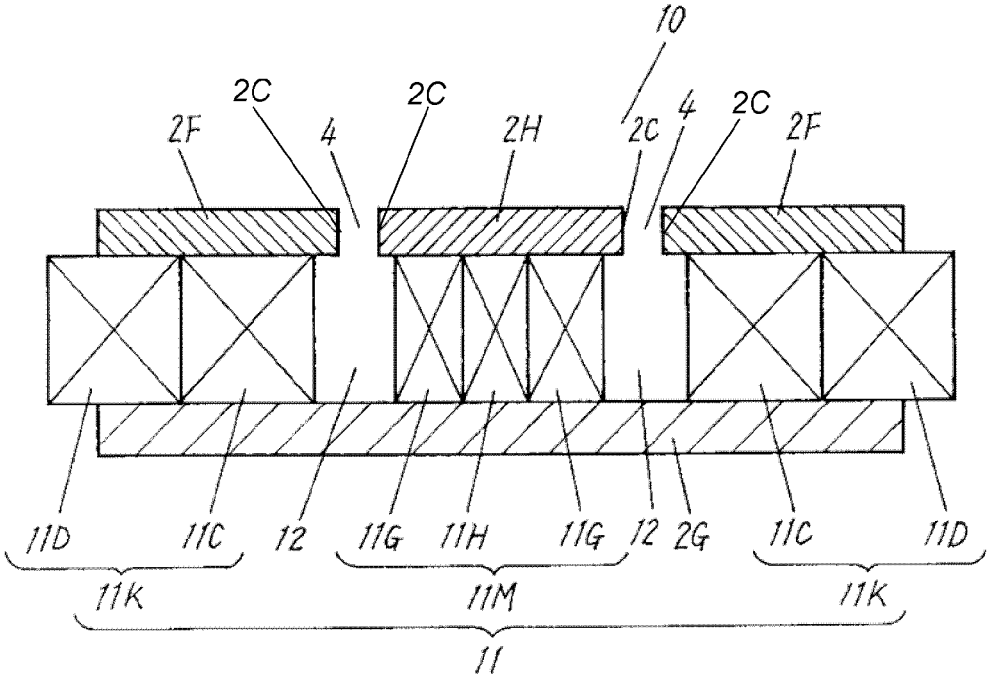
FIG. 11B is a sectional view of an inner and outer magnet type loudspeaker magnetic circuit in accordance with a second example of the third exemplary embodiment.

FIG. 11B is a sectional view of a magnetic circuit in accordance with a second example of the third exemplary embodiment. In FIG. 11B, the same reference numerals are given to the same elements as in FIG. 11A and the descriptions thereof are simplified.

Magnetic circuit 10 of this example is different from magnetic circuit 10 of the previous example in that magnet 11 is formed of bond magnet 11K and bond magnet 11M. Bond magnet 11K is formed by unitarily forming first bond magnet part 11C and second bond magnet part 11D with each other. On the other hand, bond magnet 11M is formed by unitarily forming first bond magnet part 11G and second bond magnet part 11H with each other.

First plate 2F is mounted on bond magnet 11K. On the other hand, second plate 2H is mounted on bond magnet 11M. Bond magnets 11K and 11M are placed on yoke 2G. Bond magnet 11M is disposed to be located in the center of through-hole 12 of first bond magnet 11K.

Bond magnet 11K is magnetically connected to bond magnet 11M in series via yoke 2G. Facing parts 2C are formed on the side surface of second plate 2H and the side surface of first plate 2F. As a result, magnetic gap 4 is provided between facing parts 2C.

With the above-mentioned configuration, since bond magnets 11K and 11M are connected in series in magnetic circuit 10 of this example, the magnetic flux density in magnetic gap 4 can be increased.

Furthermore, second bond magnet part 11D has a lower magnetic property than that of first bond magnet part 11C. In addition, second bond magnet part 11H has a lower magnetic property than that of first bond magnet part 11G. Therefore, second bond magnet parts 11D and 11H can be molded by using low-priced magnetic powder.

For example, a ferrite bond magnet or the like can be used as magnetic material for second bond magnet parts 11D and 11H,. On the other hand, an Nd-Fe-B magnet, an Sm-Co magnet, and an Sm-Fe-N bond magnet and the like, which have a more excellent magnetic property than the ferrite bond magnet, can be used as first bond magnet parts 11C and 11G.

Furthermore, since bond magnets 11M and 11K are disposed magnetically in series, bond magnets 11M and 11K do not repel each other when bond magnets 11M and 11K are placed on yoke 2G. Therefore, since bond magnets 11M and 11K can be easily placed on yoke 2G, assembly man-hour can be reduced.

Furthermore, bond magnet 11K of this example has a hollow circular cylindrical shape and bond magnet 11M has a columnar shape. However, the shapes are not necessarily limited to these. For example, bond magnet 11K may have substantially a rectangular shape. Furthermore, bond magnet 11M may have a rectangular shape or a race-track shape. Furthermore, bond magnets 11K disposed on both sides of bond magnet 11M are not necessarily integrated with each other.

Fourth Exemplary Embodiment

Figure 12:
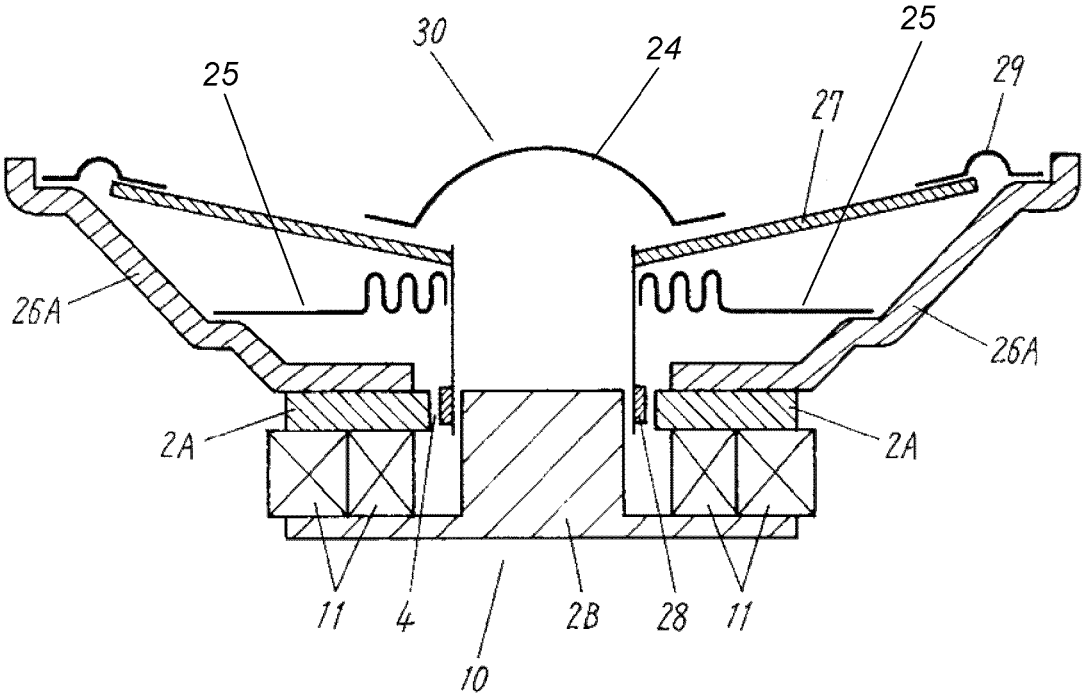
FIG. 12 is a sectional view of an outer magnet type loudspeaker in accordance with a first example of a fourth exemplary embodiment.

Hereinafter, a loudspeaker of this exemplary embodiment is described with reference to drawings. FIG. 12 is a sectional view of an outer magnet type loudspeaker in accordance with this exemplary embodiment. As shown in FIG. 12, loudspeaker 30 of this exemplary embodiment includes outer magnet type magnetic circuit 10. Magnetic circuit 10 includes magnet 11, first plate 2A, and yoke 2B. Magnet 11 is fixed to yoke 2B. First plate 2A is fixed to magnet 11.

First plate 2A of outer magnet type magnetic circuit 10 is connected to frame 26A. The outer periphery of diaphragm 27 is connected to edge 29. Furthermore, the outer periphery of edge 29 is adhesively bonded to the peripheral edge of frame 26A.

One end of voice coil 28 is connected to the center part of diaphragm 27. Another end of voice coil 28 is fitted into and magnetically connected to magnetic gap 4. For loudspeaker 30 of this exemplary embodiment, any one of magnetic circuits 10 of the first, third and fourth examples of the first exemplary embodiment is used.

The above-mentioned configuration makes it possible to obtain loudspeaker 30 having high magnetic efficiency and extremely high degree of freedom in designing, which have not been achieved by a conventional example. Furthermore, since loudspeaker 30 of this exemplary embodiment employs any one of magnetic circuits 10 of the first, third and fourth examples of the first exemplary embodiment, low-priced loudspeaker 30 can be achieved.

FIG. 13A is a sectional view of an outer magnet type loudspeaker in accordance with a second example of this exemplary embodiment. In FIG. 13A, the same reference numerals are given to the same elements as in FIG. 12 and the descriptions thereof are simplified.

Loudspeaker 30 of this example employs any one of magnetic circuits 10 of the second and fifth examples of the first exemplary embodiment. With this configuration, since a volume of second magnet part 11B shown in FIG. 2, or a volume of second magnet part 11D shown in FIG. 4B can be increased, a magnetic flux density in magnetic gap 4 can be increased. Thus, it is possible to obtain loudspeaker 30 which has a high level of sound pressure and can reproduce a high quality sound. Furthermore, since inexpensive ferrite or the like can be used for second magnet part 11B, low-priced loudspeaker 30 can be achieved.

Figure 13B:
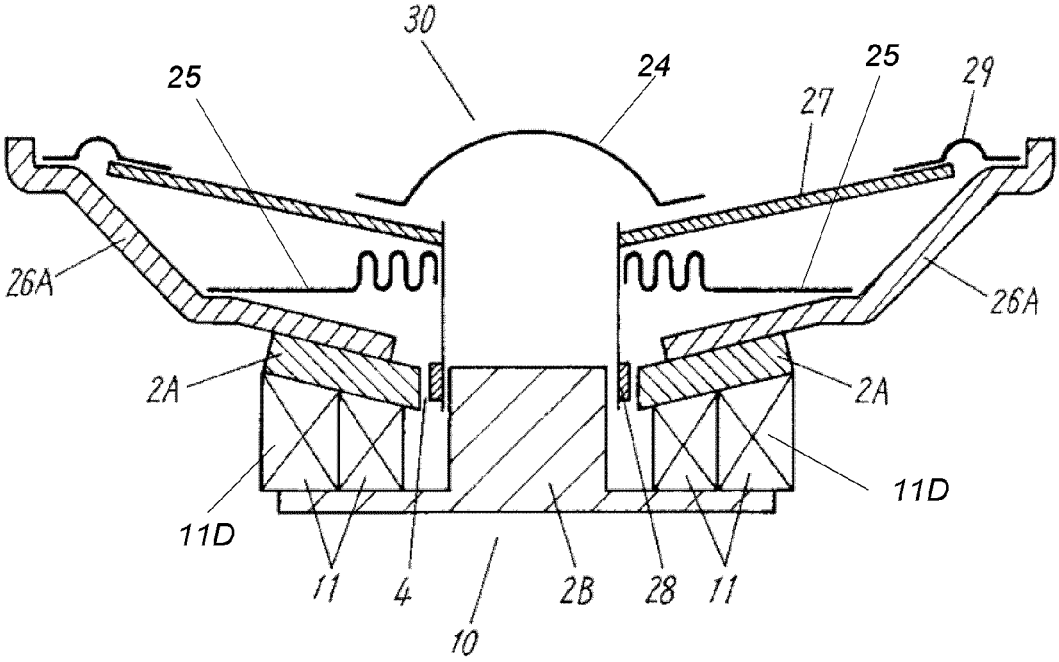
FIG. 13B is a sectional view of an outer magnet type loudspeaker in accordance with a third example of the fourth exemplary embodiment.

FIG. 13B is a sectional view of an outer magnet type loudspeaker in accordance with a third example of this exemplary embodiment. In FIG. 13B, the same reference numerals are given to the same elements as in FIGS. 12 and 13A and the descriptions thereof are simplified.

Loudspeaker 30 of this example employs any one of magnetic circuits 10 of the sixth and seventh examples of the first exemplary embodiment. With this configuration, since a volume of second bond magnet part 11D can be increased, the magnetic flux density in magnetic gap 4 can be increased. Thus, it is possible to obtain loudspeaker 30 which has a high level of sound pressure and can reproduce a high quality sound. Furthermore, since inexpensive ferrite or the like can be used for second bond magnet part 11D, low-priced loudspeaker 30 can be achieved.

Fifth Exemplary Embodiment

Figure 14:
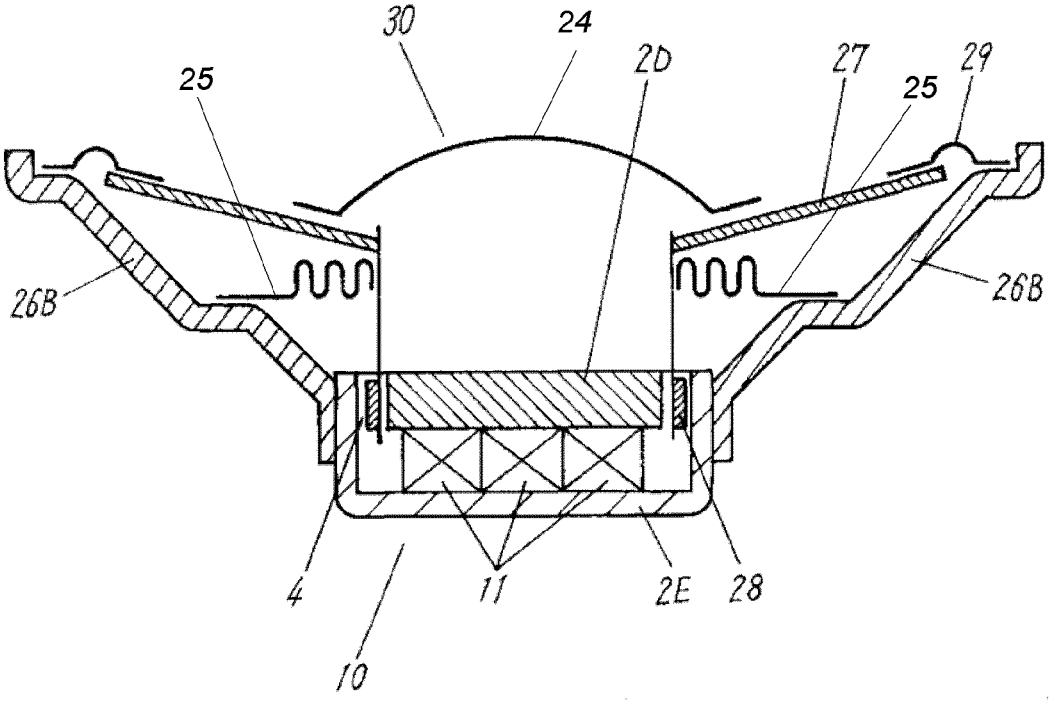
FIG. 14 is a sectional view of an inner magnet type loudspeaker in accordance with a fifth exemplary embodiment.

Hereinafter, a loudspeaker of this exemplary embodiment is described with reference to drawings. FIG. 14 is a sectional view of an inner magnet type loudspeaker in accordance with this exemplary embodiment. Loudspeaker 30 of this exemplary embodiment includes inner magnet type magnetic circuit 10 as shown in FIG. 14.

Magnetic circuit 10 includes magnet 11, first plate 2D, and yoke 2E. Magnet 11 is fixed to yoke 2E. First plate 2D is fixed to magnet 11.

Yoke 2E of this example is connected to frame 26B. The outer periphery of diaphragm 27 is connected to edge 29. The outer periphery of edge 29 is adhesively bonded to the peripheral edge of frame 26B.

One end of voice coil 28 is connected to the center part of diaphragm 27. On the other hand, another end of voice coil 28 is fitted into and magnetically connected to magnetic gap 4.

Loudspeaker 30 of this example can employ any one of magnetic circuits 10 of the first and fourth examples of the second exemplary embodiment. With this configuration, low-priced loudspeaker 30 can be achieved.

FIG. 15 is a sectional view of an inner magnet type loudspeaker in accordance with a second example of this exemplary embodiment. In FIG. 15, the same reference numerals are given to the same elements as in FIG. 14 and the descriptions thereof are simplified. Loudspeaker 30 of this example employs magnetic circuit 10 of the second or fifth example of the second exemplary embodiment. Thus, a low-priced loudspeaker can be achieved.

Furthermore, the magnetic flux density in magnetic gap 4 can be increased without increasing the thickness of loudspeaker 30. Therefore, a loudspeaker having a high level of sound pressure and high sound quality can be achieved.

Figure 16:
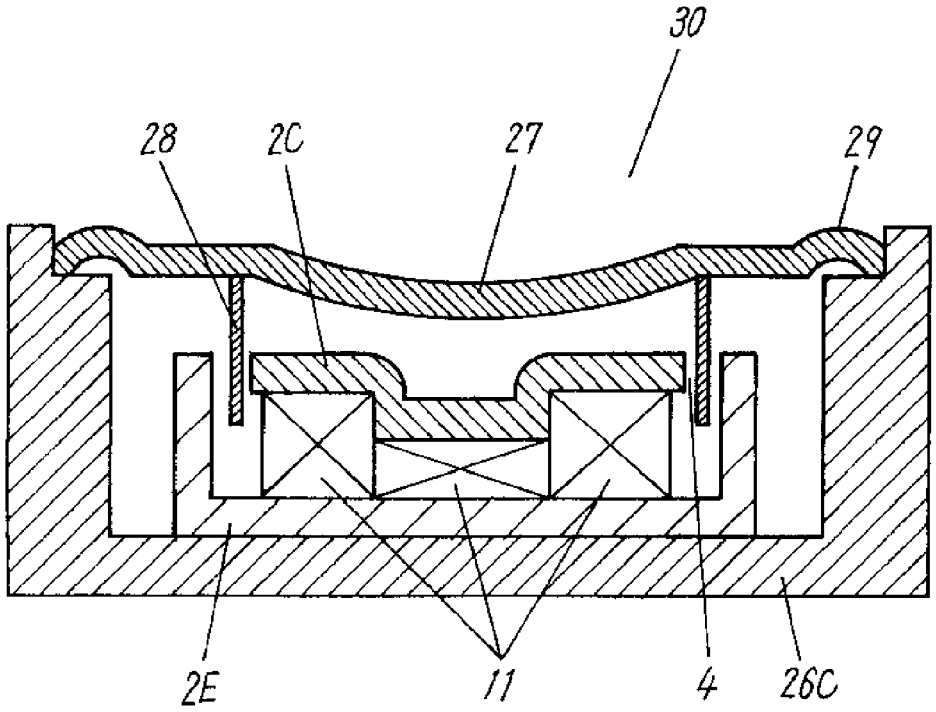
FIG. 16 is a sectional view of an inner magnet type loudspeaker in accordance with a third example of the fifth exemplary embodiment.

FIG. 16 is a sectional view of a loudspeaker having an inner magnet type loudspeaker in accordance with a third example of this exemplary embodiment. Loudspeaker 30 of this example shown in FIG. 16 can be used for portable devices including, for example, portable telephones, smartphones or tablet terminals.

Frame 26C is connected to the outer periphery of yoke 2E of this example. The outer periphery of diaphragm 27 is formed unitarily with edge 29, and the outer periphery of edge 29 is adhesively bonded to the peripheral edge of frame 26C. One end of voice coil 28 is connected to diaphragm 27. On the other hand, another end of voice coil 28 is fitted into and magnetically connected to magnetic gap 4.

Loudspeaker 30 of this example employs any one of magnetic circuits 10 of the third and sixth examples of the second exemplary embodiment. Thus, a low-priced loudspeaker can be achieved. Furthermore, since the center part of diaphragm 27 can be formed in a recess shape, the thickness of loudspeaker 30 can be reduced.

Sixth Exemplary Embodiment

Figure 17:
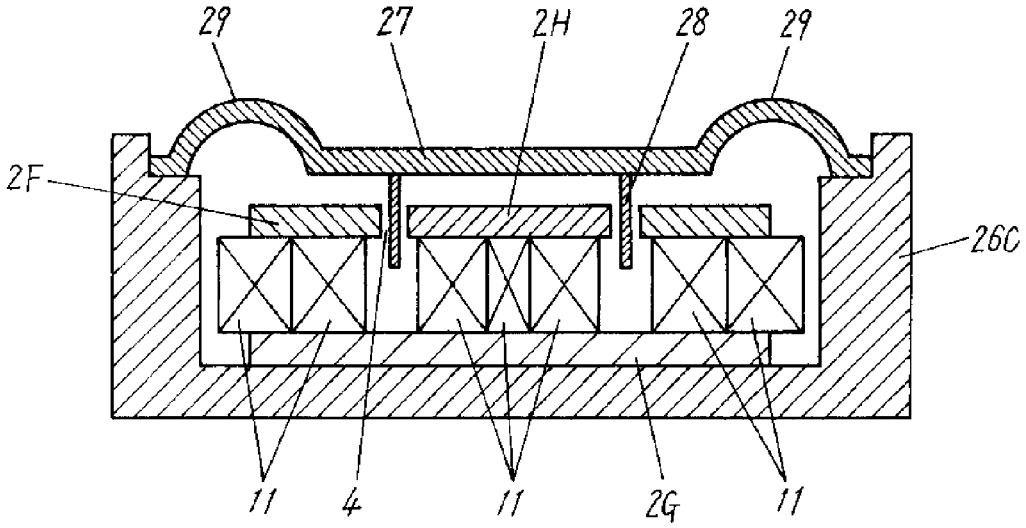
FIG. 17 is a sectional view of an inner and outer magnet type loudspeaker in accordance with a sixth exemplary embodiment.

Hereinafter, a loudspeaker of this exemplary embodiment is described with reference to drawings. FIG. 17 is a sectional view of an inner and outer magnet type loudspeaker in accordance with this exemplary embodiment. In FIG. 17, the same reference numerals are given to the same elements as in FIG. 16 and the descriptions thereof are simplified.

In FIG. 17, loudspeaker 30 of this example can be used for portable devices or the like. As shown in FIG. 17, loudspeaker 30 of this example includes inner and outer magnet type magnetic circuit 10. Inner and outer magnet type magnetic circuit 10 includes magnet 11, first plate 2F, second plate 2H, and yoke 2G. In inner and outer magnet type magnetic circuit 10, two, three, or more magnets 11 are aligned to each other, and fixed to the yoke 2G. Furthermore, first plate 2F of this example is fixed to magnet 11 disposed at the outer side. Second plate 2H of this example is fixed to magnet 11 disposed at the inner side.

Yoke 2G of magnetic circuit 10 of this example is joined to frame 26C. The outer periphery of diaphragm 27 is formed unitarily with edge 29, and the outer periphery of edge 29 is adhesively bonded to the peripheral edge of frame 26C.

One end of voice coil 28 is connected to diaphragm 27. Another end of voice coil 28 is fitted into and magnetically connected to magnetic gap 4.

Note here that loudspeaker 30 of this exemplary embodiment employs magnetic circuit 10 of third exemplary embodiment. With this configuration, low-priced loudspeaker 30 can be achieved. Furthermore, loudspeaker 30 can be achieve high magnetic flux density in magnetic gap 4 although it has a small size. Therefore, loudspeaker 30 having a high level of sound pressure and having excellent sound quality can be obtained.

What is claimed is:

1. A loudspeaker magnetic circuit comprising:

a first magnet including:

a first pole formed in an end of the first magnet, and a second pole formed in another end opposite the first pole;

a first plate joined to the first magnet on the first pole; and;

a yoke joined to the first magnet on the second pole, and facing a side surface of the first plate via a magnetic gap therebetween, wherein the first magnet includes a first magnet part, and a second magnet part having a lower magnetic property than the first magnet part, and the first magnet part and the second magnet part are magnetically connected in parallel to each other, and the second magnet part is disposed farther from the magnetic gap than the first magnet part.

2. The loudspeaker magnetic circuit according to claim 1, wherein at least one of the first magnet part and the second magnet part is a bond magnet.

3. The loudspeaker magnetic circuit according to claim 1, wherein the first and second magnet parts are formed of a single bond magnet.

4. The loudspeaker magnetic circuit according to claim 3, wherein at least one of the first plate and the yoke is unitarily molded with the bond magnet.

5. The loudspeaker magnetic circuit according to claim 4, wherein the bond magnet is formed by injection molding.

6. The loudspeaker magnetic circuit according to claim 1, wherein the first and second magnet parts are formed of bond magnets;

a side surface of the first magnet part facing the second magnet part is inclined such that a contact area between the first magnet part and the first plate is smaller than a contact area between the first magnet part and the yoke, and air or a non-magnetic substance is provided between the first magnet part and the second magnet part.

7. The loudspeaker magnetic circuit according to claim 1, wherein a distance between the first pole and the second pole of the second magnet part is larger than a distance between the first pole and the second pole of the first magnet part.

8. A loudspeaker comprising:

a loudspeaker magnetic circuit according to claim 1;

a frame joined to the magnetic circuit;

a voice coil disposed in the magnetic gap of the magnetic circuit and a diaphragm having a center part to which the voice coil is joined and a peripheral edge joined to an outer periphery of the frame.

9. A loudspeaker magnetic circuit comprising:

a first magnet including:

a first pole formed in an end of the first magnet, and a second pole formed in another end opposite the first pole;

a second magnet magnetically connected in series to the first magnet, the second magnet including:

a third pole formed in an end of the second magnet, and a fourth pole formed in another end opposite the third pole;

a first plate joined to the first magnet on the first pole;

a second plate joined to the second magnet on the fourth pole; and a yoke joined to the first and second magnets on the second and third poles respectively, wherein a magnetic gap is provided between side surfaces of the first and second plates, the first magnet includes a first magnet part, and a second magnet part having a lower magnetic property than the first magnet part, and the first magnet part and the second magnet part are magnetically connected in parallel to each other, and the second magnet part is disposed farther from the magnetic gap than the first magnet part.

10. The loudspeaker magnetic circuit according to claim 9, wherein the second magnet includes a third magnet part, and a fourth magnet part having a lower magnetic property than the third magnet part, and the third magnet part and the fourth magnet part are magnetically connected in parallel to each other, and the fourth magnet part is disposed farther from the magnetic gap than the third magnet part.

11. A loudspeaker comprising:

a loudspeaker magnetic circuit according to claim 9;

a frame joined to the magnetic circuit;

a voice coil disposed in the magnetic gap of the magnetic circuit and a diaphragm having a center part to which the voice coil is joined and a peripheral edge joined to an outer periphery of the frame.

* * * * *